US007414201B2

(12) United States Patent
Kanno et al.

(10) Patent No.: US 7,414,201 B2
(45) Date of Patent: Aug. 19, 2008

(54) TRANSMISSION LINE PAIR

(75) Inventors: Hiroshi Kanno, Osaka (JP); Kazuyuki Sakiyama, Osaka (JP); Ushio Sangawa, Nara (JP); Tomoyasu Fujishima, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 24 days.

(21) Appl. No.: 11/589,067

(22) Filed: Oct. 30, 2006

(65) Prior Publication Data

US 2007/0040628 A1 Feb. 22, 2007

Related U.S. Application Data

(63) Continuation of application No. PCT/JP2006/306524, filed on Mar. 29, 2006.

(30) Foreign Application Priority Data

Mar. 30, 2005 (JP) ..... 2005-097160

(51) Int. Cl.
*H01B 7/08* (2006.01)

(52) U.S. Cl. ..... 174/117 F

(58) Field of Classification Search ..... 174/117 F, 174/117 FF; 333/4, 5

See application file for complete search history.

(56) References Cited

U.S. PATENT DOCUMENTS 4,785,135 A * 11/1988 Ecker et al. ..... 174/34

FOREIGN PATENT DOCUMENTS

EP 1 376 747 A2 1/2004
JP 4-196601 A 7/1992
JP 07-46010 2/1995
JP 8-316709 A 11/1996
JP 11-17409 A 1/1999
JP 2000-77911 A 3/2000

(Continued)

OTHER PUBLICATIONS

"An Introduction to Signal Integrity," Jun. 1, 2002, pp. 79, CQ Publishing Co., Ltd.

(Continued)

*Primary Examiner*—Chau N Nguyen
(74) *Attorney, Agent, or Firm*—McDermott Will & Emery LLP

(57) ABSTRACT

In a transmission line pair including a first transmission line and a second transmission line which is so placed in adjacency that a coupled line region to be coupled with the first transmission line is formed, in the coupled line region, the first transmission line includes a first signal conductor which is placed on one surface which is either a top face of a substrate formed from a dielectric or semiconductor or an inner-layer surface parallel to the top face and which has a linear shape along its transmission direction, and the second transmission line includes a second signal conductor which is placed on the one surface of the substrate and which partly includes a transmission-direction reversal region for transmitting a signal along a direction having an angle of more than 90 degrees with respect to the transmission direction within the plane of the placement, and which has a line length different from that of the first signal conductor.

12 Claims, 25 Drawing Sheets

FOREIGN PATENT DOCUMENTS

| | | | |
|---|---|---|---|
| JP | 2002-299917 | A | 10/2002 |
| JP | 2003-258394 | A | 9/2003 |
| JP | 2004-48750 | A | 2/2004 |
| JP | 2004-274172 | | 9/2004 |

OTHER PUBLICATIONS

Japanese Office Action issued in corresponding Japanese Patent Application No. JP 2006-524148, dated Mar. 13, 2007.

* cited by examiner

TRANSMISSION LINE PAIR

This is a continuation application of International Application No. PCT/JP2006/306524, filed Mar. 29, 2006.

BACKGROUND OF THE INVENTION

1. Field of the Invention

The present invention relates to transmission lines for transmitting analog radio-frequency signals of microwave band, millimeter-wave band or the like, or digital signals. More specifically, the invention relates to a transmission line pair including a first transmission line and a second transmission line placed so as to allow itself to be coupled with the first transmission line, and also relates to a radio-frequency circuit including such a transmission line pair.

2. Description of the Related Art

FIG. 17A shows a schematic cross-sectional structure of a microstrip line which has been used as a transmission line in such a conventional radio-frequency circuit as shown above. As shown in FIG. 17A, a signal conductor 103 is formed on a top face of a board 101 made of a dielectric or semiconductor, and a grounding conductor layer 105 is formed on a rear face of the board 101. Upon input of radio-frequency power to this microstrip line, an electric field arises along a direction from the signal conductor 103 to the grounding conductor layer 105, and a magnetic field arises along such a direction as to surround the signal conductor 103 perpendicular to lines of electric force. As a result, the electromagnetic field propagates the radio-frequency power in a lengthwise direction perpendicular to the widthwise direction of the signal conductor 103. In addition, in the microstrip line, the signal conductor 103 or the grounding conductor layer 105 do not necessarily need to be formed on the top face or the rear face of the board 101, but the signal conductor or the grounding conductor layer 105 may be formed within the inner-layer conductor surface of the circuit board on condition that the board 101 is provided as a multilayer circuit board.

The above description has been made on a transmission line for use of transmission of single-end signals. However, as shown in a sectional view of FIG. 17B, two microstrip line structures may be provided in parallel so as to be used as differential signal transmission line with signals of opposite phases transmitted through the lines, respectively. In this case, since paired signal conductors 103*a*, 103*b* have signals of opposite phases flow therethrough, the grounding conductor layer 105 may be omitted.

In a conventional analog circuit or high-speed-digital circuit, a cross-sectional structure of which is shown in FIG. 18A and a top view of which is shown in FIG. 18B, two or more transmission lines 102*a*, 102*b* are often placed in adjacency and parallel to each other with a high density in their adjoining distance, giving rise to a crosstalk phenomenon between the adjoining transmission lines with the issue of isolation deterioration involved, in many cases. As shown in non-patent document 1, the origin of the crosstalk phenomenon can be attributed to both mutual inductance and mutual capacitance.

Now the principle of occurrence of a crosstalk signal is explained with reference to a perspective view FIG. 19 (a perspective view corresponding to the structure of FIGS. 18A and 18B) of a transmission line pair of two lines placed in parallel and in adjacency to each other with the dielectric substrate 101 assumed as a circuit board. Two transmission lines 102*a*, 102*b* are so constructed that the grounding conductor layer 105 formed on the rear face of the dielectric substrate 101 is used as their grounding conductor portions while two signal conductors placed in adjacency and parallel to each other on a top face of the dielectric substrate 101 are used as their signal conductor portions. Assuming that both ends of these transmission lines 102*a*, 102*b* are terminated by unshown resistors, respectively, radio-frequency circuit characteristics of the two transmission lines 102*a*, 102*b* can be understood by substituting current-flowing closed current loops 293*a*, 293*b* for the two transmission lines 102*a*, 102*b*, respectively.

Also, as shown in FIG. 19, each of current loops 293*a*, 293*b* is made up of a signal conductor which makes a current flow on the top face of the dielectric substrate 101, a grounding conductor 105 on the rear face on which a return current flows, and a resistive element (not shown) which connects the two conductors to each other in a direction vertical to the dielectric substrate 101. It is noted here that the resistive element introduced in such a circuit (i.e., in a current loop) may be not a physical element but a virtual one in which its resistance components are distributed along the signal conductors, where the resistive element may be regarded as one having the same value of characteristic impedance as that of the transmission lines.

Next, the crosstalk phenomenon that would arise upon a flow of a radio-frequency signal in each current loop 293*a* is concretely explained with reference to FIG. 19. First, as a radio-frequency current 853 flows in the current loop 293*a* along a direction indicated by an arrow in the figure upon transmission of a radio-frequency signal, a radio-frequency magnetic field 855 is generated so as to intersect the current loop 293*a*. Since the two transmission lines 102*a*, 102*b* are placed in proximity to each other, the radio-frequency magnetic field 855 intersects even the current loop 293*b* of the transmission line 102*b*, so that an induced current 857 flows in the current loop 293*b*. This is the principle of development of a crosstalk signal due to mutual inductance.

Based on this principle, the induced current 857 generated in the current loop 293*b* flows toward a near-end side terminal (i.e., a terminal in an end portion on the front side in the figure) in a direction opposite to the direction of the radio-frequency current 853 in the current loop 293*a*. Since intensity of the radio-frequency magnetic field 855 depends on the loop area of the current loop 293*a* and since intensity of the induced current 857 depends on the intensity of the radio-frequency magnetic field 855 intersecting the current loop 293*b*, the crosstalk signal intensity increases more and more as a coupled line length Lcp of the transmission line pair composed of the two transmission lines 102*a*, 102*b* increases.

Further, another crosstalk signal is induced to the transmission line 102*b* due to the mutual capacitance occurring to between the two signal conductors as well. The crosstalk signal generated by the mutual capacitance has no directivity, and occurs to both far-end and near-end sides each at an equal intensity. The crosstalk phenomenon occurring on the far-end side can be construed as a sum of the above two phenomena. Now, current elements generated in the transmission line pair in accompaniment to the crosstalk phenomenon during transmission of high-speed signals are shown in a schematic explanatory view of FIG. 20. As shown in FIG. 20, when a voltage Vin is applied to a terminal 106*a* on the left side of the transmission line 102*a* as in the figure, a radio-frequency current element Io flows through the transmission line 102*a* due to a radio-frequency component contained at a pulse leading edge. A difference between a current Ic generated due to a mutual capacitance by this radio-frequency current element Io and a current Ii generated due to the mutual inductance flows as a crosstalk current into a far-end side crosstalk terminal 106*d* of the adjacently placed transmission line

102*b*. On the other hand, a crosstalk current corresponding to the sum of currents Ic and Ii flows into a near-end side crosstalk terminal 106*c*. Under such a condition that paired transmission lines are placed in proximity to each other at a high density, the current Ii is generally higher in intensity than the current Ic, and therefore a crosstalk voltage Vf of the negative sign, which is inverse to the sign of the voltage Vin applied to the terminal 106*a* is observed at the far-end side crosstalk terminal 106*d*. In addition, a voltage Vout is observed at a terminal 106*b* of the transmission line 102*a*.

Here is explained a typical example of crosstalk characteristics in conventional transmission lines. For example, as shown in FIGS. 18A and 18B, on a top face of a dielectric substrate 101 of resin material having a dielectric constant of 3.8, a thickness H of 250 μm and having a grounding conductor layer 105 provided over its entire rear face, is fabricated a radio-frequency circuit having a structure that two signal conductors, i.e. transmission lines 102*a* and 102*b*, with a wiring width W of 100 μm are placed in parallel with a wire-to-wire gap G set to 650 μm, where one radio-frequency circuit defined here and having a coupled line length of 50 mm is assumed as Prior Art Example 1 and another of 500 mm as Prior Art Example 2 (it is noted that Prior Art Example 2 will be mentioned later). A wiring distance D, which is a placement distance of the two transmission lines 102*a*, 102*b*, is G+(W/2)×2=750 μm. It is noted that those signal conductors are provided each by a copper wire having an electrical conductivity of $3\times10^8$ S/m and a thickness of 20 μm.

With respect to such a radio-frequency circuit of Prior Art Example 1, forward transit characteristics by four terminal measurement (terminal 106*a* to terminal 106*b*) as well as far-end directed isolation characteristics (terminal 106*a* to terminal 106*d*) are explained below with reference to a graph-form view showing the frequency dependence of the isolation characteristics about the radio-frequency circuit of Prior Art Example 1 shown in FIG. 21. It is noted that in the graph of FIG. 21, the horizontal axis represents frequency (GHz) and the vertical axis represents a transit intensity characteristic S21 (dB) and isolation characteristic S41 (dB).

As shown by the isolation characteristic S41 of FIG. 21, the crosstalk intensity monotonously increases with increasing frequency. More specifically, it can be understood that even an isolation of 11 db with the frequency band of 5 GHz or higher, or 7 db with the frequency band of 10 GHz or higher, or as small as 3 db with the frequency band of 20 GHz or higher cannot be ensured. Furthermore, as longer the coupled line length Lcp becomes, or as the placement distance D is decreased, the crosstalk intensity monotonously increases.

Also, as shown by the transit intensity characteristic S21 (indicated by thin line in the figure) of FIG. 21, as the crosstalk signal intensity increases, the transit signal intensity extremely lowers. Specifically, there occurs a decrease of as much as 9.5 db in the signal intensity at 25 GHz. In the radio-frequency circuit of Prior Art Example 1, with transit through a line length of 50 mm, a transit phase of a signal having a frequency of about 1.8 GHz corresponds to 180 degrees. The crosstalk intensity at this frequency is −21.4 db. Although depending on the placement distance D, the crosstalk phenomenon matters in frequency bands in which the coupled line length Lcp corresponds effectively to a wavelength order, i.e. an effective line length of half-wave length or more. For example, decreasing the placement distance D to 200 μm causes the crosstalk intensity to become −15.8 db, and the extending the placement distance D to 1000 μm cause the crosstalk intensity to become 26.7 db. Also, with the placement distance D equal to 200 μm, it becomes impossible to maintain a crosstalk intensity of −10 dB at a frequency of 11.6 GHz at which the coupled line length Lcp corresponds to about 2.5 times the effective wavelength. Also with the placement distance D equal to 750 μm, a crosstalk intensity of −10 db is recorded at a frequency of 25.7 GHz at which the coupled line length Lcp corresponds to about 7 times the effective wavelength. Thus, although depending on the degree of coupling between lines, influences of the crosstalk phenomenon becomes quite considerable under the condition that the coupled line length Lcp corresponds to a double or more of the effective wavelength.

As a conventional technique purposed to suppress such a crosstalk phenomenon, there has been a transmission line structure shown in patent document 1 as an example. The transmission line structure shown in patent document 1 is a structure which is effective for optimizing the electromagnetic field distribution of high frequencies during signal transmission to reduce the crosstalk about a unit line length. That is, since it is the coupling between parallel lines described above that makes the factor of the crosstalk, this is a technique intended to suppress the crosstalk phenomenon by providing a transmission line cross-sectional structure which is so designed as to reduce the degree of coupling between parallel lines. More specifically, as shown in a cross-sectional structure of a transmission line pair of FIG. 22, a second dielectric 145 which is lower in dielectric constant than a first dielectric 144 serving as the substrate is distributed at a partial site of the substrate between two signal conductors 142 and 143 of the transmission line pair. Since the radio-frequency electric field intensity of the signal traveling on the transmission lines is lowered at the distribution site of the second dielectric 145 of low dielectric constant, the degree of coupling between the transmission lines can be lowered, thus making it achievable to suppress the crosstalk phenomenon.

Patent document 1: Japanese Unexamined Patent Publication No. 2002-299917 A

Patent document 2: Japanese Unexamined Patent Publication No. 2003-258394 A

Non-patent document 1: An introduction to signal integrity (CQ Publishing Co., Ltd., 2002) pp. 79

SUMMARY OF THE INVENTION

However, the conventional transmission line pair formed of microstrip lines as shown above has principle-based issues shown below.

The forward crosstalk phenomenon that occurs in the conventional transmission line pair can make a factor of circuit malfunctions from the following two viewpoints. First, at an output terminal to which an input terminal of a transmission signal is connected, there occurs an unexpected decrease in signal intensity, so that a circuit malfunction erupts. Second, among wide-band frequency components that can be contained in the transmission signal, in particular, higher-frequency components involve higher leak intensity, so that the crosstalk signal has a very sharp peak on the time base, giving rise to malfunctions in the circuit connected to the far-end side terminal of the adjacent transmission line. These phenomena become noticeable when the coupled line length Lcp is set over 0.5 time the effective wavelength λg of electromagnetic waves of the radio-frequency components contained in the transmitted signal.

With reference to a schematic explanatory view of FIG. 23, principle and characteristics of the far-end crosstalk that occurs to the adjacent transmission line by transmission of radio-frequency signals are explained. Referring to FIG. 23, a radio-frequency signal to be transmitted from left to right in the figure is generated at a first transmission line 102*a* by application of a positive-voltage pulse Vin to an input terminal 106*a*. In this case, the first transmission line 102*a* is coupled to the transmission line 102*b* continuously over its lengthwise direction. Also, in each of the transmission lines 102*a*, 102*b*, a left-end site in the figure where the coupling is started is defined as a position coordinate L=0, and a right-end site where the coupling is terminated is defined as a position coordinate L=Lcp. It is noted that Lcp denotes coupled line length. Further, the schematic explanatory view of FIG. 23 shows a relationship between crosstalk signals which are generated at different two points (site A and site B) of a transmission line pair in a coupled line region, which is the structural part formed by two lines to be coupled as shown above, by transmission of radio-frequency signals. For simplification of the explanation about the relationship, only voltage components that advance toward the far end side are shown in the figure.

As shown in FIG. 23, from a radio-frequency signal 301*a* which starts from the input terminal 106*a* in the first transmission line 102*a* and travels at the site A of the second transmission line 102*a* at time T=To, there occurs a crosstalk voltage 301*b* that is directed toward the far-end side crosstalk terminal 106*d*. Thereafter, at time T1 (=To+ΔT) after an elapse of ΔT since time To, in the first transmission line 102*a*, the radio-frequency signal 301*a* travels in a direction to go farther from the input terminal 106*a* by a line length ΔL1 to reach the site B, resulting in a radio-frequency signal 302*a*. In this case, the line length ΔL1 can be expressed as shown by Equation 1:

$$\Delta L1=\Delta T\times v=\Delta T\times c/\sqrt{(\in)} \quad \text{(Eq. 1)}$$

where v is the propagation velocity of the radio-frequency signal in the transmission line, c is the velocity of the electromagnetic wave in a vacuum, and ∈ is the effective dielectric constant of the transmission line.

Also, as shown in FIG. 23, at the site B as well, there occurs a crosstalk voltage 302*b* from the radio-frequency signal 302*a* in the first transmission line 102*a* to the second transmission line 102*b*. On the other hand, the crosstalk signal 301*b* generated at the site A at the time To travels on the second transmission line 102*b* and, at time T1 after an elapse of time Δt, reaches a position distanced by a line length ΔL2 expressed by Equation 2:

$$\Delta L2=\Delta T\times c/\sqrt{(\in)} \quad \text{(Eq. 2)}$$

Since ΔL1=ΔL2 in conventional transmission line pairs, the radio-frequency signal 301*a* that has been generated at the site A and traveled along the second transmission line 102*b* and the crosstalk signal 302*b* that has been generated at the site B are added up at just the same timing on the second transmission line 102*b*. Since this relationship keeps normally holding over the coupled line length of the coupled line region in which the paired transmission lines are coupled together, the intensity of a crosstalk waveform observed at the far-end crosstalk terminal 106*d* would be a cumulatively added-up result of weak crosstalk signals that have been generated at all sites.

In the radio-frequency circuit of Prior Art Example 1 described above, upon input of a pulse having a rise time and a fall time each of 50 picoseconds and a pulse voltage of 1 V was inputted to the terminal 106*a*, such a crosstalk waveform as shown in FIG. 24 was observed at the far-end side terminal 106*d*. Also, the absolute value of the observed crosstalk voltage Vf reached as much as 175 mV. In addition, that the sign of a crosstalk signal corresponding to the rising edge of the positive-sign pulse voltage resulted in the opposite sign is due to the fact, from the above description, that the crosstalk current Ii induced by the mutual inductance was larger in intensity than the crosstalk current Ic generated by an effect of the mutual capacitance.

On the other hand, however, in order to meet strict demands for circuit miniaturization from the market, a radio-frequency circuit needs to be implemented in a dense placement with the shortest possible distance between adjacent circuits or distance between transmission lines by using fine circuit formation techniques. Further, since semiconductor chips or boards have been going larger and larger in size along with the diversification of objected applications, the distance along which connecting wires are adjacently led around between circuits is elongated, so that the coupled line length of the parallel coupled lines has been keeping on increasing. Moreover, with increases in speeds of transmission signals, the line length effectively increases even in parallel coupled lines that have been permitted in conventional radio-frequency circuits, so that the crosstalk phenomenon has been becoming noticeable. That is, for the conventional transmission line technique, it is desired to form, with a saved area, a radio-frequency circuit in which high isolation is maintained in radio-frequency band, but it is difficult to meet the desire, disadvantageously.

The technique of patent document 1 introduced in the prior art is capable of reducing the far-end side crosstalk signal intensity per unit length. However, the point that the far-end side crosstalk signal intensity increases with improving transmission frequency, i.e., the point that the far-end side crosstalk signal has a high-pass characteristic has not been solved at all. As a result of this, for example, under the coupled line length Lcp is a double or more of the effective wavelength of electromagnetic wave, there is a problem that the phenomenon that the far-end crosstalk intensity extremely increases with the transit signal intensity extremely decreased by power leak is not solved in principle. Furthermore, the conventional issue that the far-end crosstalk signal waveform comes to have a very sharp peak configuration (i.e., a locally acutely protruding configuration) to cause a circuit malfunction as a "spike noise" cannot be totally solved, as a further problem. Consequently, by the technique of patent document 1, although the far-end crosstalk signal intensity that would occur in the radio-frequency circuit of Prior Art Example 1 shown also in FIG. 24 as an example can be made lower than 175 mV (0.175 V), yet the configuration of the pulse waveform cannot be changed, so that a circuit malfunction is caused by occurrence of a spike noise, as a problem.

In addition to patent document 1, patent document 2 can be mentioned as a literature related to the present invention. Patent document 2, unlike the foregoing patent document 1, includes no optimization of the cross-sectional structure of parallel coupled lines, so does not seek strength reduction of crosstalk elements generated per unit length. The document has an aim of flattening the sharp spike noise occurring at the far-end terminal by keeping on shifting the timing of adding up crosstalk elements occurring per unit length, but is insufficient in its effects, problematically.

Accordingly, an object of the present invention, lying in solving the above-described problems, is to provide a transmission line pair which is capable of maintaining successful isolation characteristics, and particularly capable of preventing occurrence of spike noise having a sharp peak at the far-end crosstalk terminal and therefore avoiding any extreme deterioration of transit signal intensity.

In order to achieve the above object, the present invention has the following constitutions.

According to a first aspect of the present invention, there is provided a transmission line pair comprising:

a first transmission line; and a second transmission line which is so placed in adjacency to the first transmission line that a coupled line region is formed, the coupled line region having a coupled line length being 0.5 time or more as long as an effective wavelength in the first transmission line at a frequency of a transmitted signal, wherein in the coupled line region, the first transmission line comprises a first signal conductor which is placed on one surface which is either a top face of a substrate formed from a dielectric or semiconductor or an inner-layer surface parallel to the top face and which has a linear shape along a transmission direction thereof, and the second transmission line comprises a second signal conductor which is placed on the one surface of the substrate and which partly includes a transmission-direction reversal region for transmitting a signal along a direction having an angle of more than 90 degrees with respect to the transmission direction within the plane of the placement, and which has a line length different from that of the first signal conductor.

Whereas a crosstalk signal finally generated at a far-end crosstalk terminal of the transmission line pair is a sum of weak crosstalk signals generated per unit length, there is an issue, in conventional transmission line pairs, that crosstalk signals generated at different sites within the coupled line region are added up at the same timing on the time base in adjacent transmission lines, incurring an increase in crosstalk signal intensity eventually. In the transmission line pair of the first aspect, with a view to solving this issue, an effective line length difference is provided between the first and second transmission lines to set an effective dielectric constant difference between the transmission lines, by which crosstalk signals generated at different sites within the coupled line region are added up while the timing keeps normally shifted in time in the second transmission line. As a result, even in the case where the coupled line length Lcp of the transmission line pair corresponds to a half or more of the effective wavelength, the intensity of the crosstalk signal finally generated at the far-end crosstalk terminal is effectively suppressed, so that the resulting waveform does not become "spike noise" but rather can be formed into a "white noise" like one. Further, since increases of the crosstalk signal intensity can be suppressed, successful characteristics can be maintained also for transit signal intensity in the transmission line pair of the first aspect. Further, since the second transmission line includes the second signal conductor containing the transmission-direction reversal region, the far-end crosstalk signal generated from the signal traveling along the first transmission line can be made, in the transmission-direction reversal region, to travel toward a direction reverse to the normal direction of the far-end crosstalk signal. Thus, in the second transmission line as a whole, crosstalk signals can be canceled out, so that the crosstalk suppression effect can be further increased.

As a more preferable condition, the effective line length difference ΔLeff between the first transmission line and the second transmission line is set to preferably a half-wave length or more, more preferably to one-wave length or more in the transmission signal frequency. That is, the effective line length difference ΔLeff is preferably set as shown in Equation 3 or 4:

$$\Delta Leff \geqq 0.5\times\lambda \quad \text{(Eq. 3)}$$

$$\Delta \mathrm{Leff} \geqq \lambda \quad \text{(Eq. 4)}$$

where λ is the electromagnetic wave length at the transmission signal frequency.

In this connection, assuming that the coupled line length is Lcp and effective dielectric constants of the first transmission line and the second transmission line are ∈1 and ∈2, respectively, then ΔLeff can be defined as shown by Equation 5:

$$\Delta Leff = Lcp\times\{\sqrt{(\in 2)}-\sqrt{(\in 1)}\} \quad \text{(Eq. 5)}$$

According to a second aspect of the present invention, there is provided the transmission line pair as defined in the first aspect, wherein an absolute value of a difference between a product of the coupled line length and a square root of an effective dielectric constant of the first transmission line and a product of the coupled line length and a square root of an effective dielectric constant of the second transmission line is 0.5 time or more as long as a wavelength at the frequency of the signal transmitted in the first transmission line or the second transmission line.

According to a third aspect of the present invention, there is provided the transmission line pair as defined in the first aspect, wherein an absolute value of a difference between a product of the coupled line length and a square root of an effective dielectric constant of the first transmission line and a product of the coupled line length and a square root of an effective dielectric constant of the second transmission line is 1 time or more as long as a wavelength at the frequency of the signal transmitted in the first transmission line or the second transmission line.

According to a fourth aspect of the present invention, there is provided the transmission line pair as defined in the first aspect, wherein in the coupled line region, the second transmission line includes a plurality of the transmission-direction reversal regions.

According to a fifth aspect of the present invention, there is provided the transmission line pair as defined in the first aspect, wherein the transmission-direction reversal region contains a region for transmitting the signal toward a direction rotated 180 degrees with respect to the transmission direction.

According to a sixth aspect of the present invention, there is provided the transmission line pair as defined in the first aspect, further comprising, in the coupled line region, a proximity dielectric placed closer to the second transmission line than to the first transmission line.

According to a seventh aspect of the present invention, there is provided the transmission line pair as defined in the sixth aspect, wherein at least part of a surface of the second signal conductor is coated with the proximity dielectric.

According to an eighth aspect of the present invention, there is provided the transmission line pair as defined in the first aspect, wherein the second transmission line has an effective dielectric constant higher than an effective dielectric constant of the first transmission line, and a signal transmitted in the first transmission line is higher in a transmission speed than a signal transmitted in the second transmission line.

According to a ninth aspect of the present invention, there is provided the transmission line pair as defined in the eighth aspect, wherein in the coupled line region, the first transmission line is a differential transmission line including a pair of two transmission lines.

According to a tenth aspect of the present invention, there is provided the transmission line pair as defined in the first aspect, wherein the second transmission line is a bias line for supplying electric power to active elements.

According to an eleventh aspect of the present invention, there is provided the transmission line pair as defined in the first aspect, wherein in the coupled line region, the second transmission line has an effective dielectric constant different from an effective dielectric constant of the first transmission line.

According to a twelfth aspect of the present invention, there is provided the transmission line pair as defined in the eleventh aspect, wherein an effective-dielectric-constant difference setting region, in which a difference in effective dielectric constant between the first transmission line and the second transmission line is set, is allocated all over the coupled line region.

According to a thirteenth aspect of the present invention, there is provided the transmission line pair as defined in the eleventh aspect, wherein the coupled line region includes:

an effective-dielectric-constant difference setting region in which a difference in effective dielectric constant between the first transmission line and the second transmission line is set, and an effective-dielectric-constant difference non-setting region in which the difference in effective dielectric constant is not set, wherein a line length of the effective-dielectric-constant difference non-setting region is shorter than 0.5 time the effective wavelength in the first transmission line.

According to a fourteenth aspect of the present invention, there is provided the transmission line pair as defined in the thirteenth aspect, wherein in the coupled line region, a line length of one of the effective-dielectric-constant difference non-setting regions placed in succession is shorter than 0.5 time the coupled line length.

Herein, the term "coupled line region" refers to, in a transmission line pair composed of a first transmission line and a second transmission line placed in adjacency to each other, a line structure portion or line structure region in a section over which the two transmission lines are in a partly or entirely coupled relation. More specifically, in the two transmission lines, the coupled line region can also be said to be a line structure portion of a section in which signal transmission directions of the respective transmission lines as a whole are in a parallel relation. It is noted that, the term "couple" refers to transit of electrical energy (e.g., electric power, voltage, etc.) from one transmission line to another transmission line.

According to the transmission line pair of the present invention, it becomes possible not only to flatten, on the time base, sharp "spike noise" that would occur at far-end terminals by the crosstalk phenomenon in conventional transmission line pairs, but also to reduce the peak intensity of the flattened crosstalk waveform by a suppression effect for crosstalk element intensities that would occur per unit length, so that malfunctions in the circuit to which the second transmission line is connected can be avoided. Further, since deterioration of the transit signal intensity can be avoided by suppression of the crosstalk phenomenon, power-saving operations of the circuit can be practically fulfilled. Furthermore, since the need for decoupling radio-frequency components contained in the signal is eliminated, circuit occupation areas that would conventionally be occupied by bypass capacitors or other chip components or grounding via holes or grounding conductor patterns can be saved.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
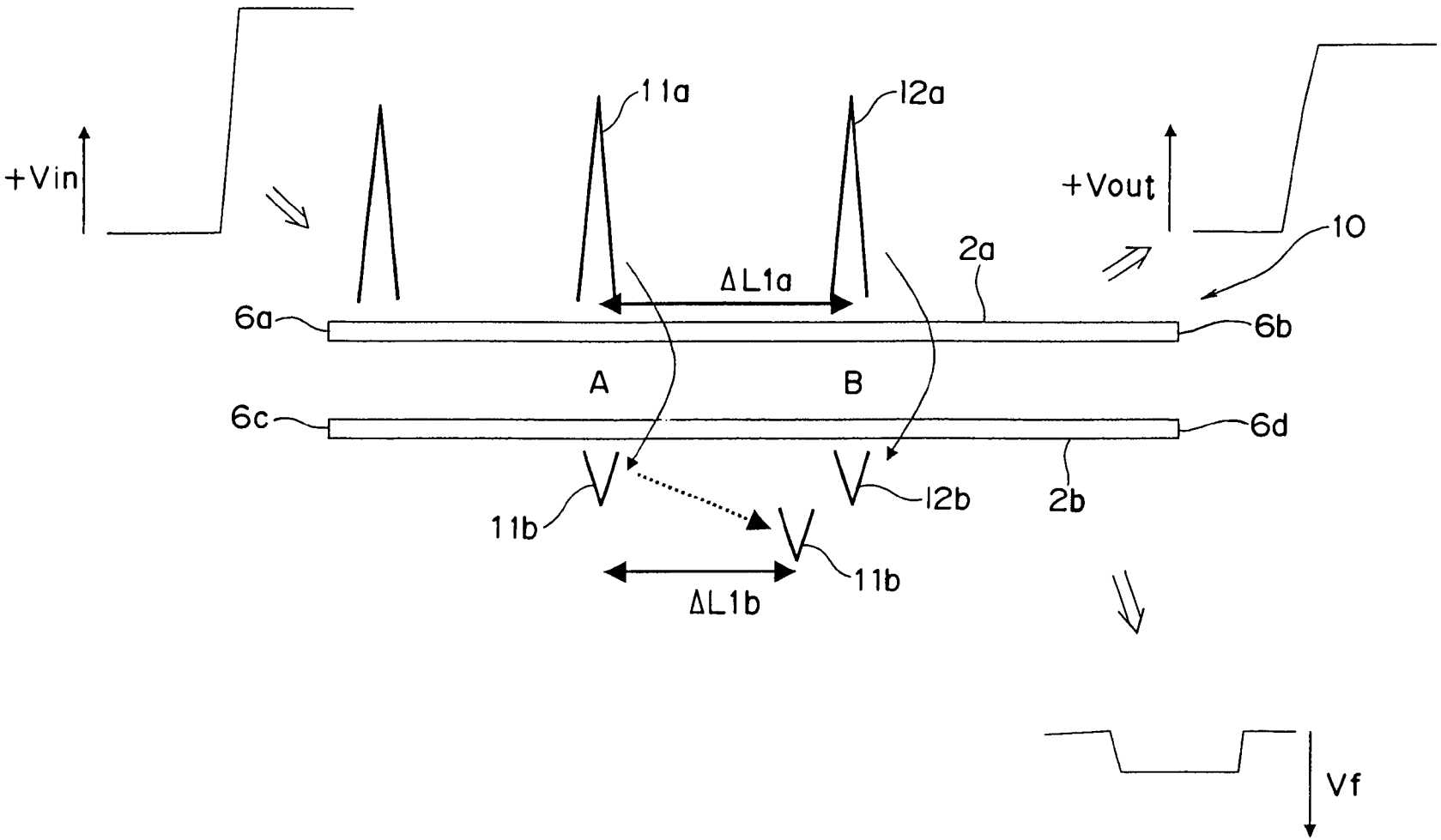
FIG. 1 is a schematic explanatory view for explaining the principle of current elements and a far-end crosstalk occurring during transmission of radio-frequency signals in a transmission line pair according to the present invention.

Before the description of the present invention proceeds, it is to be noted that like parts are designated by like reference numerals throughout the accompanying drawings.

Hereinbelow, one embodiment of the present invention is described in detail with reference to the accompanying drawings.

Before the description of embodiments of the invention, first, the principle of the present invention for suppressing the crosstalk occurring in a transmission line pair to avoid the generation of a sharp spike noise is explained with reference to the accompanying drawings.

Figure 23:
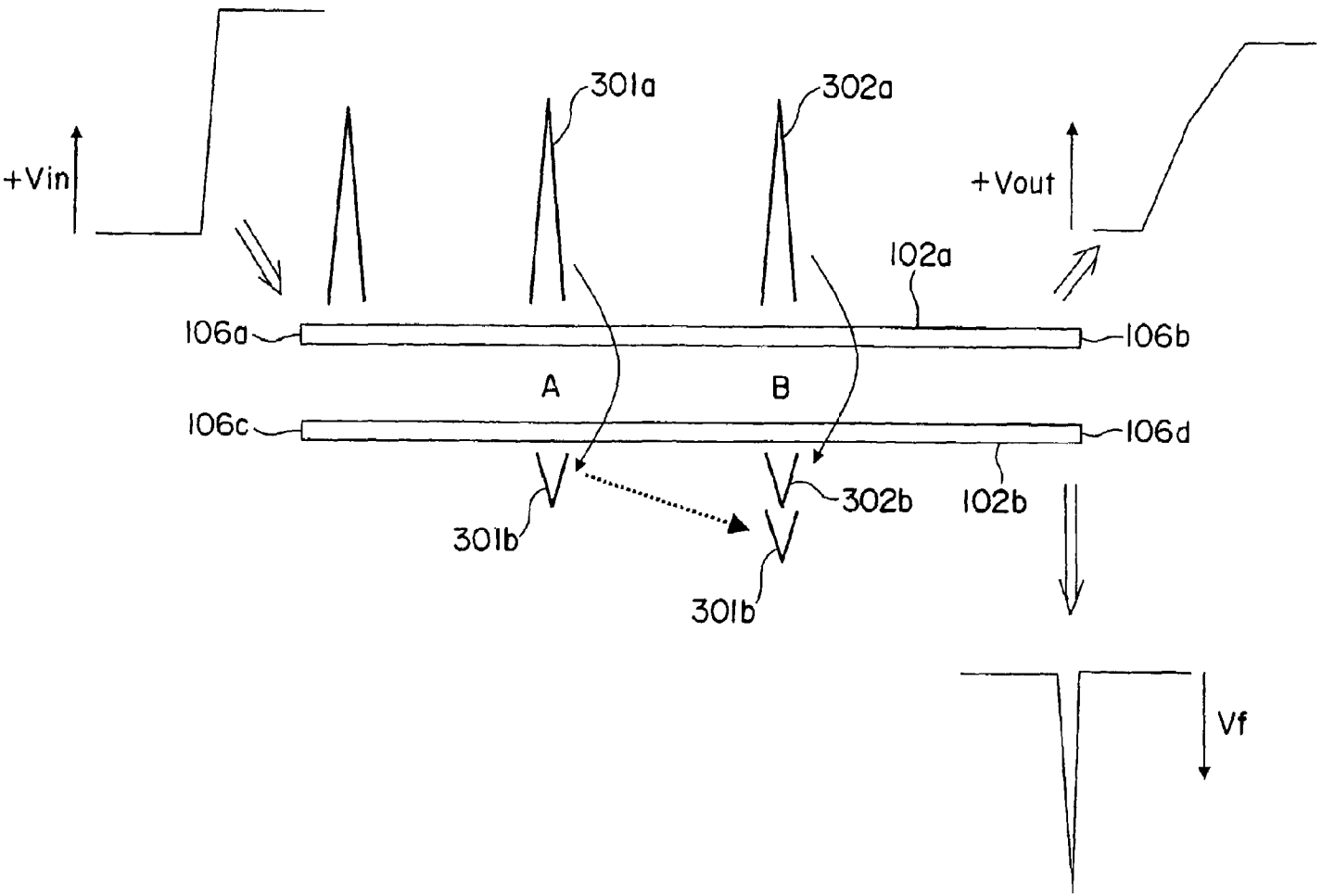
Fig. 23 (PRIOR ART)
FIG. 23 is a schematic explanatory view for explaining the principle of current elements and a far-end crosstalk occurring during signal transmission in a conventional transmission line pair.
Figure 24:
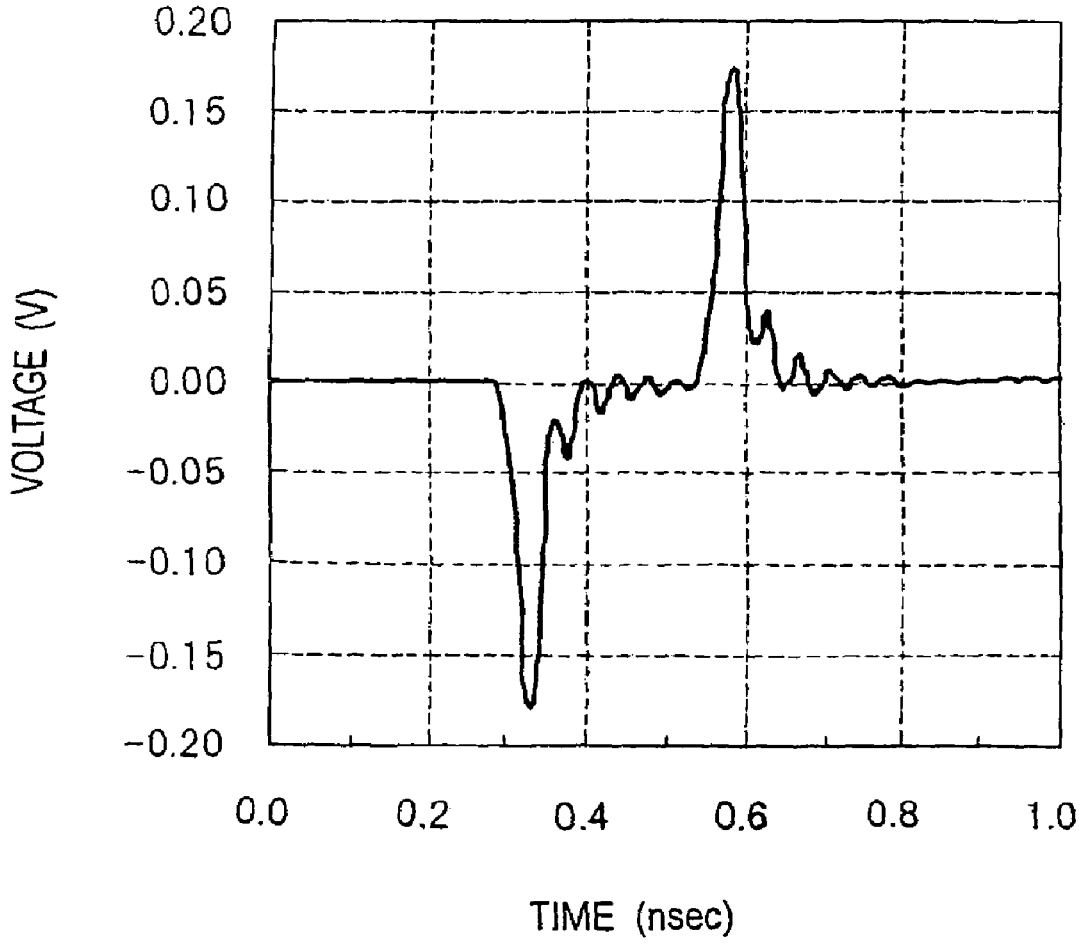
Fig.24 (PRIOR ART)
FIG. 24 is a view in the form of a graph showing a crosstalk voltage waveform observed at the far-end crosstalk terminal upon application of a pulse to the transmission line pair of Prior Art Example 1.

FIG. 1 is a schematic explanatory view for explaining the principle of the present invention, corresponding to FIG. 23 with which the principle of crosstalk occurrence in conventional transmission line pairs has been schematically explained. In FIG. 1, description on common settings is omitted for an easier understanding of the following description.

As shown in FIG. 1, as at least two transmission lines, a first transmission line 2*a* and a second transmission line 2*b* are placed in a pair in adjacency and parallel to each other, by which a transmission line pair 10 coupled over a coupled line length Lcp is made up. An effective dielectric constant ∈1 of the first transmission line 2*a* and an effective dielectric constant ∈2 of the second transmission line 2*b* are set to mutually different values, e.g., as ∈1<∈2. Since the present invention relates to transmission line pairs of such coupled line lengths that the crosstalk intensity becomes considerable, the coupled line length Lcp has at least a length effectively corresponding to the half-wave length or more in the first transmission line 2*a* for electromagnetic waves (signals) of at least transmission frequencies (see Eq. 6):

$$Lcp \geqq 0.5 \times \lambda / \sqrt{(\in 1)} \quad \text{(Eq. 6)}$$

In addition, although not shown in FIG. 1, further more transmission lines may also be placed in parallel in the vicinity of the transmission line pair 10 (i.e., first transmission line 2*a* and second transmission line 2*b*) of the present invention. If conditions that should be satisfied by the transmission line pair of the present invention as shown below are satisfied by at least one transmission line pair among such a transmission line group, it is implementable to obtain the effects of the present invention also in the transmission line group.

First, as shown in FIG. 1, in the transmission line pair 10, a radio-frequency signal to be transmitted from left-end to right-end side in the figure is generated in the first transmission line 2*a* by application of a positive-voltage pulse Vin to an input terminal 6*a* (position coordinate L=0). In the first transmission line 2*a*, the radio-frequency signal 11*a* that has started from the input terminal 6*a* reaches site A by time T=To, giving rise to a crosstalk voltage 11*b* which is directed toward a far-end side crosstalk terminal 6*d* in the adjoining and coupled second transmission line 2*b*.

Also, at time T1 (=To+ΔT) after an elapse of ΔT since the time To, the radio-frequency signal 11*a* on the first transmission line 2*a* advances by a line length ΔL1*a* toward a direction of going farther from the input terminal 6*a* (i.e., rightward direction in the figure), reaching site B and resulting in a radio-frequency signal 12*a*. Now, given a propagation velocity v1 of the first transmission line 2*a*, a velocity c of electromagnetic waves in a vacuum and an effective dielectric constant ∈1 of the first transmission line 2*a*, the line length ΔL1*a* in the first transmission line 2*a* can be expressed as shown by Equation 7:

$$\Delta L1a = \Delta T \times v1 = \Delta T \times c / \sqrt{(\in 1)} \quad \text{(Eq. 7)}$$

Further, at this site B as well, in the second transmission line 2*b*, a crosstalk signal 12*b* due to the radio-frequency signal 12*a* of the first transmission line 2*a* is generated. Meanwhile, in the second transmission line 2*b*, the crosstalk signal 11*b* generated at site A at time To also advances toward the far-end side on the second transmission line 2*b*, reaching at time T1 after an elapse of time ΔT to a position that is distant from site A by line length ΔL1*b*. Here, given that the propagation velocity of the second transmission line 2*b* is v2, then the line length ΔL1*b* in the second transmission line 2*b* can be expressed as shown by Equation 8:

$$\Delta L1b = \Delta T \times v2 = \Delta T \times c / \sqrt{(\in 2)} \quad \text{(Eq. 8)}$$

In this case, since an effective dielectric constant difference is set in the transmission line pair 10 so that, for example, $\in 1 < \in 2$, it holds that $\Delta L1a > \Delta L1b$. Therefore, in the second transmission line 2*b*, the crosstalk signal 11*b* generated at time To does not yet reach the site B by time T1. That is, the crosstalk signal 11*b* that has been generated at site A and advanced in the second transmission line 2*b* and the crosstalk signal 12*b* that has been generated at site B are not added up at the same timing on the second transmission line 2*b*.

Further, a similar phenomenon occurs also at site C (not shown) distant from site B by line length ΔL, so that the crosstalk signal 11*b* generated at site A, the crosstalk signal 12*b* generated at site B and a crosstalk signal 12*c* (not shown) generated at site C are added up at timings slightly shifted from one another on the second transmission line 2*b*. Since this relationship normally holds over the coupled line region (e.g., coupling-effected region) in which the transmission lines 2*a*, 2*b* are adjacently coupled to each other, a crosstalk signal waveform reaching the far-end crosstalk terminal 6*d* cannot be "spike noise" having a sharp peak waveform, but can be made into a flat waveform like "white noise." It is noted that since the transmission line pair 10 shown in FIG. 1 has a structure including the coupling between the terminal 6*a* of the first transmission line 2*a* and the terminal 6*b* and between a terminal 6*c* of the second transmission line 2*b* and the terminal 6*d*, the transmission line pair 10 in its entirety forms the coupled line region, and the overall line length of the transmission line pair 10 equals the coupled line length Lcp.

At this point, based on the above principle, particularly preferable conditions that should be satisfied by the effective dielectric constants $\in 1$, $\in 2$ of the two transmission lines 2*a*, 2*b* as their relationship to effectively obtain the effects of the present invention are determined.

A first preferable condition is that an effective line length difference ΔLeff between the two transmission lines 2*a*, 2*b* corresponds to 0.5 time or more the wavelength λ in the vacuum of the transmission frequency that travels along either the first transmission line 2*a* or the second transmission line 2*b* (see Eq. 3), and a second preferable condition is that the effective line length difference ΔLeff corresponds to one time the wavelength λ (see Eq. 4). Further, the effective line length difference ΔLeff can be defined as shown in Equation 5 by using the coupled line length Lcp, the effective dielectric constant $\in 1$ of the first transmission line 2*a*, and the effective dielectric constant $\in 2$ of the second transmission line 2*b*. It is noted that the effective dielectric constants of the transmission lines can be derived not only analytically, but also in an experimental fashion from respective transit phases of the two transmission lines constituting the transmission line pair.

Figure 2:
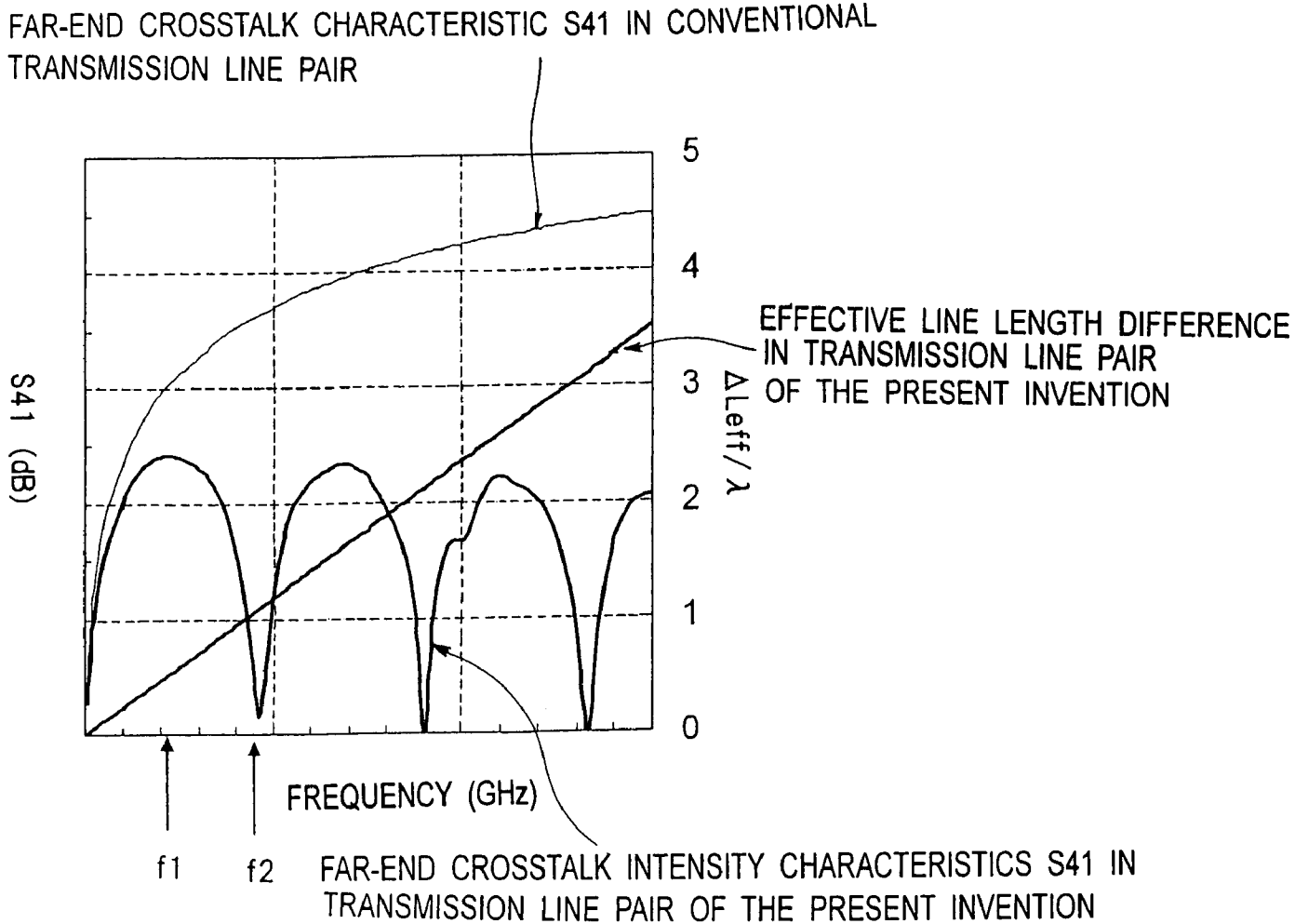
FIG. 2 is a view in the form of a graph showing an example of frequency dependence of far-end crosstalk intensity and effective line length difference in the transmission line pair of the present invention, with a conventional transmission line taken as a comparison object.

In FIG. 2, frequency dependence of far-end crosstalk intensity in the transmission line pair 10 having a specific line length is shown by bold line. It is noted that in FIG. 2, the horizontal axis represents frequency (with frequency higher on the right side in the figure), where a frequency dependence S41 of the far-end crosstalk intensity (expressed in db, with far-end crosstalk intensity increasing progressively toward the upper side in the figure) is shown along the left-side vertical axis while the effective line length difference ΔLeff of the transmission line pair 10 is shown along the right-side vertical axis at the same time. It is noted that the value of the effective line length difference ΔLeff on the right-side vertical axis is given by a value normalized by the wavelength λ.

Also in FIG. 2, a conventional transmission line characteristic example is shown by thin line as a comparative example, in which a transmission line pair is so made up that a transmission line corresponding to the second transmission line 2*b* in the transmission line pair 10 of the invention is replaced with the first transmission line 2*a*, and the placement distance D of the two transmission lines is set as equal in value, so that a comparison can be made.

As shown in FIG. 2, the far-end crosstalk intensity in the conventional transmission line pair monotonously increases with increasing frequency, while the far-end crosstalk intensity in the transmission line pair 10 of the present invention does not monotonously increase even if the frequency increases. In more detail, if a frequency at which the effective line length difference ΔLeff equals 0.5×λ is f1, the far-end crosstalk intensity increases with increasing frequency in the frequency band in which the frequency f<f1, but decreases in the degree of increase before the frequency f reaches f1, coming to a maximum value with f=f1 or its vicinities and decreasing in turn with f>f1. Thus, it can be understood that the crosstalk intensity is suppressed certainly at f=f1 as compared with the conventional transmission line pair, and that the degree of the suppression increases with increasing frequency with f>f1. Also, at a frequency f2 which is double the value of the frequency f1, the effective line length difference ΔLeff is equal to the wavelength λ, and the far-end crosstalk intensity in the transmission line pair 10 of the present invention forcedly assumes a minimum value. Further, in the frequency region in which f>f2, although the far-end crosstalk intensity cyclically assumes a maximum value at such frequencies that the effective line length difference ΔLeff becomes an odd multiple of 0.5×λ, yet the maximum value equals the value obtained at frequency f=f1, necessarily resulting in an intensity lower than the crosstalk intensity shown by the conventional transmission line pair under the same frequency condition.

Figure 3:
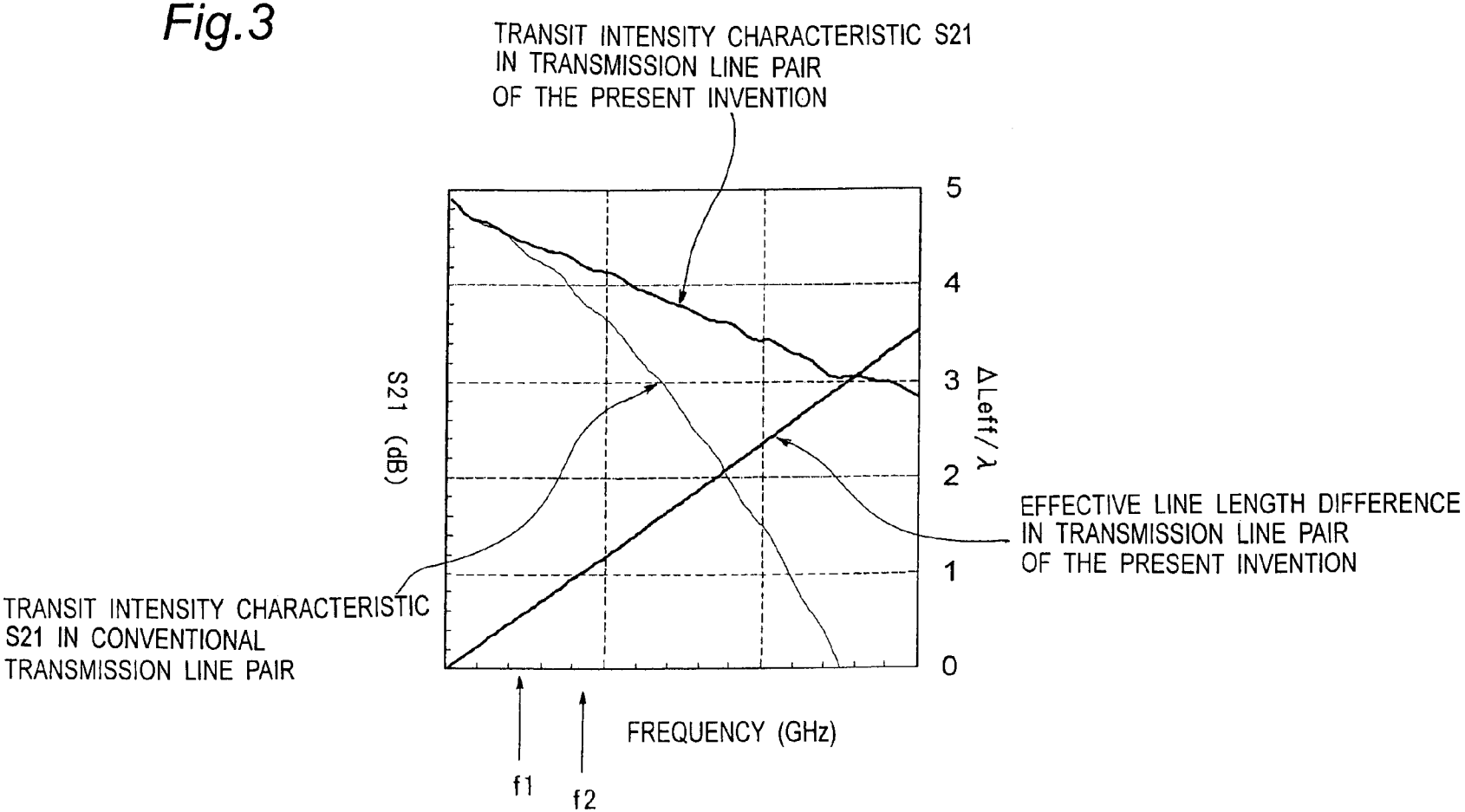
FIG. 3 is a view in the form of a graph showing an example of frequency dependence of transit intensity characteristics and effective line length difference in the transmission line pair of the present invention, with a conventional transmission line taken as a comparison object.

Along with the suppression of the far-end crosstalk intensity described above, such characteristic improvement as shown by bold line in FIG. 3 can be obtained also in terms of transit intensity characteristics. It is noted that in FIG. 3, a transit intensity characteristic S21 (expressed in db, with transit intensity characteristic decreasing progressively toward the lower side in the figure) is shown along the left-side vertical axis and the normalized effective line length difference ΔLeff/λ is shown along the right-side vertical axis, while the frequency (with frequency higher on the right side in the figure) is shown along the horizontal axis. As shown in FIG. 3, it can be understood that clearer characteristic improvements can be obtained at frequencies higher than the frequency f1, and particularly at frequencies higher than the frequency f2, in the characteristics by the constitution of the present invention in comparison to the conventional characteristics shown by thin line.

Therefore, if the transmission line pair 10 of the present invention satisfies the condition, as shown in Equation 3, that $$\Delta Leff \geqq 0.5\times\lambda, \text{ or}$$

more preferably, as shown in Equation 4, that $$\Delta Leff \geqq \lambda,$$

then it follows that the crosstalk suppression effect can securely be obtained.

The principle and effects in the transmission line pair of the present invention as described above can concretely be fulfilled by artificially yielding an effective dielectric constant difference in the transmission line pair through concrete means shown below. Techniques for artificially yielding such an effective dielectric constant difference are concretely explained below by using a transmission line pair according to an embodiment of the present invention.

Embodiment

Figure 4A:
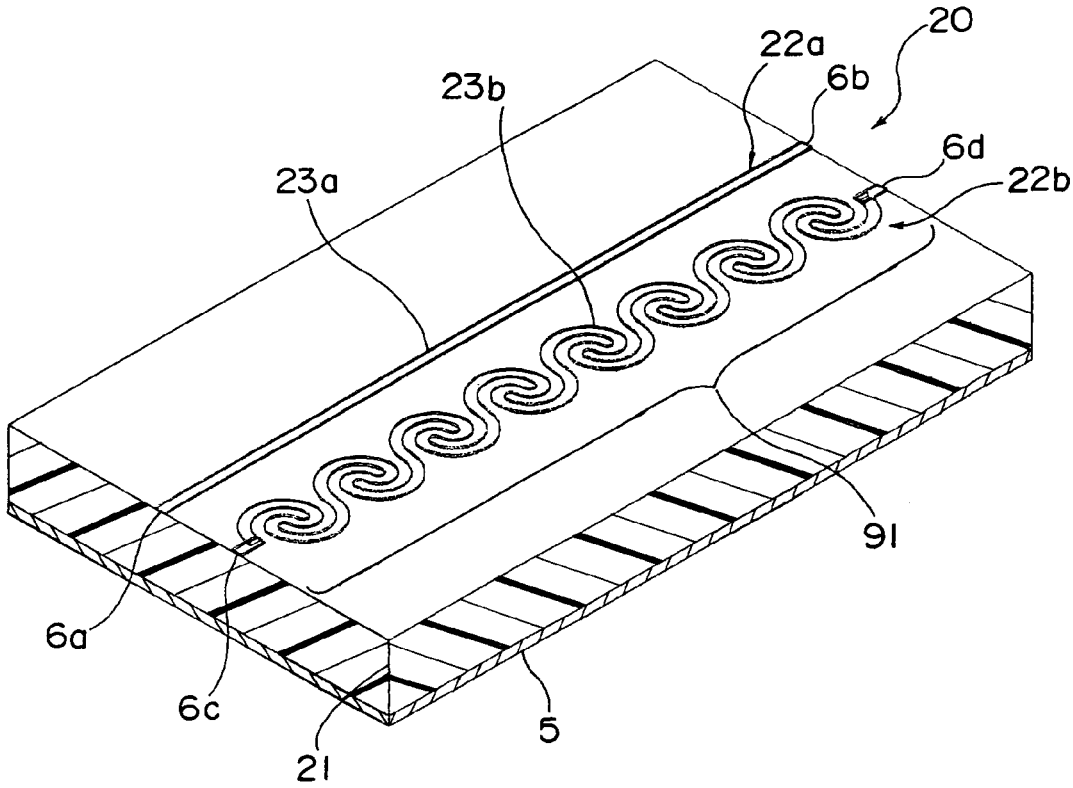
FIG. 4A is a schematic perspective view showing the structure of a transmission line pair according to an embodiment of the present invention.
Figure 4B:
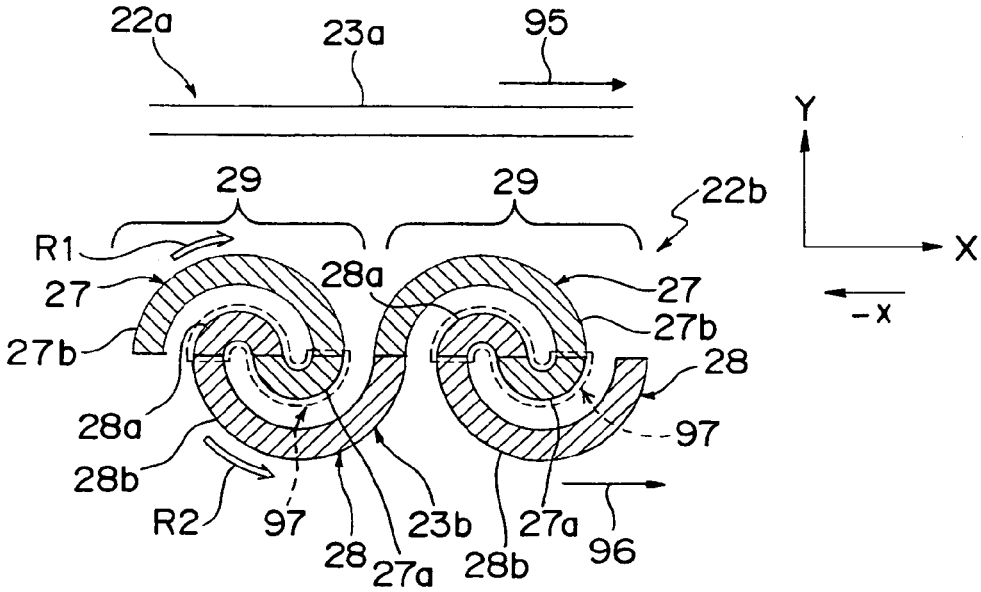
FIG. 4B is a partly enlarged schematic plan view of the transmission line pair of FIG. 4A.

FIG. 4A shows a schematic perspective view showing the structure of a transmission line pair 20 of this embodiment, and FIG. 4B shows a partly enlarged top view in which the structure of the transmission line pair 20 of FIG. 4A is partly enlarged.

As shown in FIGS. 4A and 4B, in the transmission line pair 20, a first transmission line 22*a* includes a first signal conductor 23*a* formed on a top face of a circuit board 21 and a grounding conductor 5 formed on a rear face of the circuit board 21, while a second transmission line 22*b* includes a second signal conductor 23*b* formed on the top face of the circuit board 21 and the grounding conductor 5 formed on the rear face of the circuit board 21. It is noted that the transmission line pair 20 of this embodiment is not limited to such a construction, and instead of such a case, for example, it is also possible that the first transmission line 22*a* is a differential transmission line pair and the first transmission line 22*a* does not include the grounding conductor 5, where the effects of the present invention can also be obtained. The following description is simplified on the assumption that the first transmission line 22*a* and the second transmission line 22*b* are provided in a single end construction including at least a combination of the signal conductors 23*a*, 23*b* and the grounding conductor 5.

In the transmission line pair 20 of this embodiment shown in FIGS. 4A and 4B, the second signal conductor 23*b* of the second transmission line 22*b* is partly curved, more specifically, the signal is locally meandered toward a direction different from the direction of signal transmission, by which the effective dielectric constant $\in$2 of the second transmission line 22*b* is increased. The structure adopted as the configuration of such meanders in the second transmission line 22*b* is that rotational-direction reversal structures 29, in each of which spiral-shaped signal conductors are alternately inversely rotated, are connected one to another cyclically in series.

In detail, in the second transmission line 22*b* shown in FIG. 4B, with the rightward direction in the figure assumed as a signal transmission direction 96 of the overall transmission line, the second signal conductor 23*b* of the second transmission line 22*b* of this embodiment has, at least a partial region, a structure that a curved signal conductor 27 and a curved signal conductor 28 are electrically connected to each other, where the curved signal conductor 27 is curved in a first rotational direction (clockwise direction in the figure) R1 in the top surface of the circuit board 21 in such a manner that a radio-frequency current is rotated by just one rotation in a spiral shape (i.e., 360-degree rotation) in the direction, and the curved signal conductor 28 is curved in a second rotational direction (counterclockwise direction in the figure) R2, which is opposite to the first rotational direction R1, in such a manner that a radio-frequency current is rotated (inverted) by just one rotation in a spiral shape in the direction. In this embodiment, such a structure forms a rotational-direction reversal structure 29. It is noted that in the signal conductor 22*b* shown in FIG. 4B, the curved signal conductor 27 curved in the first rotational direction R1 and the curved signal conductor 28 curved in the second rotational direction R2 are hatched in mutually different patterns for a clear showing of ranges of the signal conductors 27 and 28, respectively.

In more detail, as shown in FIG. 4B, the curved signal conductor 27 curved in the first rotational direction is composed of, for example, a combination of partial (semi-) circular-arc structures having different curvatures, i.e., a first partial circular-arc structure 27*a* having a first curvature and a second partial circular-arc structure 27*b* having a second curvature smaller than the first curvature. The curved signal conductor 28 curved in the second rotational direction, also having a similar construction, is composed of a combination of a first partial circular-arc structure 28*a* having a first curvature and a second partial circular-arc structure 28*b* having a second curvature smaller than the first curvature. Also, with a base point given by one point on a center axis of the second signal conductor 23*b*, a rotational-direction reversal structure is formed by making couplings so that end portions of an S-like structure formed by the two first partial circular-arc structures 27*a*, 28*a* being coupled to each other by their one end at the base point so as to be in point symmetry about the base point are coupled, in the same directions as those of the end portions, to end portions of the second partial circular-arc structures 27*b*, 28*b*, respectively, so that the rotational-direction reversal structure 29 is formed in point symmetry about the base point.

In the rotational-direction reversal structure 29 as shown above, for example, assuming that the rightward direction as viewed in FIG. 4B generally corresponds to the signal transmission direction, a signal transmission path is formed in such a fashion that, at the left end of one rotational-direction reversal structure 29 as in the figure, a signal transmitted toward a direction which is 90-degree leftward rotated from the transmission direction 96 (i.e., toward the upward direction in the figure) is rotated in its transmission direction clockwise by 360 degrees with respect to the base point during passage through the second partial circular-arc structure 27*b* and the first partial circular-arc structure 27*a* in the curved signal conductor 27, and moreover rotated in its transmission direction counterclockwise by 360 degrees with respect to the base point during passage from the base point through the first partial circular-arc structure 28*a* and the second partial circular-arc structure 28*b* in the curved signal conductor 28. That is, the rotational-direction reversal structure 29 is so formed that the transmission direction of a signal to be transmitted is rotated by one rotation in a clockwise and spirally-converging direction with respect to the base point, and thereafter rotated by one rotation in a counterclockwise and spirally-opening direction.

Also, as shown in FIG. 4A, the second transmission line 22*b* has a structure that a plurality of rotational-direction reversal structures 29 are connected to one another cyclically in series over the entirety of the line between the terminal 6*c* and the terminal 6*d*. Further, although the second transmission line 22*b* has such rotational-direction reversal structures 29, yet the signal transmission direction 96 as the overall transmission line has a parallel relationship with the signal transmission direction 95 in the first transmission line 22*a*. Accordingly, between the terminal 6*a* and the terminal 6*b* in the first transmission line 22*a* and between the terminal 6*c* and the terminal 6*d* in the second transmission line 22*b*, the two transmission lines have a coupling relationship so that the entirety of the transmission line pair 20 forms a coupled line region 91.

Thus, in the transmission line pair 20, since the second transmission line 22*b* has a plurality of rotational-direction reversal structures 29 connected cyclically in series, the line length of the second transmission line 22*b* can be made larger as compared with the line length of the first transmission line 22*a* in the coupled line region 91, so that the second transmission line 22*b* can be made to function as a uniform transmission line with its effective dielectric constant increased on average, with respect to the first transmission line 22*a*. Like this, it also becomes possible to set the effective dielectric constant $\in$2 in the second transmission line 22*b* larger as compared with the effective dielectric constant $\in$1 of the first transmission line 22*a*, so that sharp spike noise can be dissipated from the crosstalk waveform to form a gentle white-noise shaped waveform, making it achievable to effectively obtain the above-described effects of the present invention.

Further, as shown in FIG. 4B, for the rotational-direction reversal structure 29 of the second transmission line 22*b*, it is particularly preferable that a transmission-direction reversal section (transmission-direction reversal region or transmission-direction reversal portion) 97 for locally transmitting the signal toward a direction which differs from the signal transmission direction 96 (or signal transmission direction 95) by more than 90 degrees be included in the structure. That is, signal transmission directions in the respective first partial circular-arc structures 27*a* and 28*a* located in close proximities to the center of the rotational-direction reversal structure 29 are those differing from the transmission direction 96 by more than 90 degrees and further including a direction reversed by 180 degrees. Therefore, in the rotational-direction reversal structure 29, a structural portion formed by the first partial circular-arc structures 27*a* and 28*a* forms a transmission-direction reversal section 97.

Thus, in the second transmission line 22*b*, in which a structure including the transmission-direction reversal section 97 is adopted, a far-end crosstalk signal generated from a signal traveling along the first transmission line 22*a* travels in a direction opposite to the direction of a normal far-end crosstalk signal (i.e., transmission direction 95), in the transmission-direction reversal section 97. That is, the setting of the transmission-direction reversal section 97 has a function of canceling a normal crosstalk signal. Accordingly, by the inclusion of the transmission-direction reversal section 97 in the rotational-direction reversal structure 29, the crosstalk suppression effect can be further increased.

Figure 25:
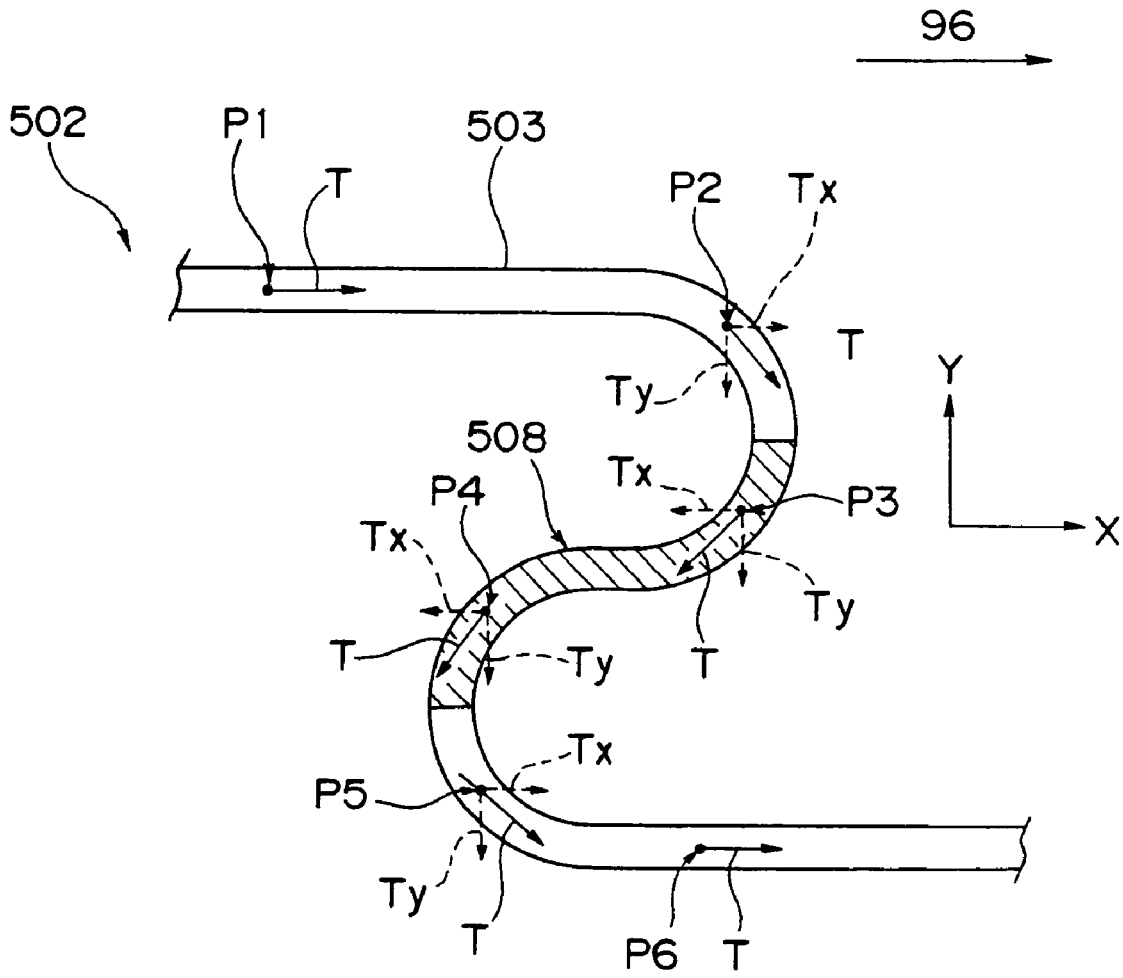
FIG. 25 is a schematic plan view for explaining a transmission direction and a transmission-direction reversal section in a transmission line of the foregoing embodiment of the present invention.

Now, the signal transmission direction in a transmission line is explained below with reference to a schematic plan view of a transmission line 502 shown in FIG. 25. Herein, the transmission direction is a tangential direction of a signal conductor when the signal conductor has a curved shape, and the transmission direction is a longitudinal direction of a signal conductor when the signal conductor has a linear shape. More specifically, by taking an example of the transmission line 502 formed of a signal conductor 503 having a signal conductor portion of a linear shape and a signal conductor portion of a circular-arc shape as shown in FIG. 25, at local positions P1 and P2 in the linear-shaped signal conductor portion, the transmission direction T is the rightward direction, which is the longitudinal direction of the signal conductor, in the figure. On the other hand, at local positions P2 to P5 in the signal conductor portion of the circular-arc shape, their transmission directions T are tangential directions at the local positions P2 to P5, respectively.

Also, in the transmission line 502 of FIG. 25, assuming that the signal transmission direction 96 in the whole transmission line 502 is the rightward direction as viewed in the figure, and that this direction is the X-axis direction and a direction orthogonal to the X-axis direction within the same plane is the Y-axis direction, then the transmission direction T at each of positions P1 to P6 can be decomposed into Tx, which is a component in the X-axis direction, and Ty, which is a component in the Y-axis direction. Tx becomes a + (positive) X-direction component at positions P1, P2, P5 and P6, while Tx becomes a − (negative) X-direction component at positions P3 and P4. Herein, a structural portion in which the transmission direction contains a − X-direction component as shown above is a "transmission-direction reversal structure (section)." More specifically, the positions P3 and P4 are positions within a transmission-direction reversal structural portion 508, and a hatched portion in the signal conductor of FIG. 25 serves as the transmission-direction reversal structure 508. It is noted that, herein, the terms "reverse the transmission direction" or "transmit a signal in a direction which differs from the transmission direction 96 of the whole transmission line by more than 90 degrees" refer to, in FIGS. 4B or 25, making a −x component generated in a vector in a local signal transmission direction in the transmission line, where the transmission direction 95, 96 is assumed as the X-axis direction and a direction orthogonal to this X-axis direction is assumed as the Y-axis direction.

Also, in the second transmission line 22*b* of the transmission line pair 20 shown in FIGS. 4A and 4B, the number of spiral rotations within a unit structure of the rotational-direction reversal structure 29 is set to one rotation for each of the clockwise and counterclockwise directions, but the structure of the transmission line pair 20 of this embodiment is not limited only to such a case. Instead of the case where the number of spiral rotations is set to one rotation, it is also allowable, for example, that a rotational-direction reversal structure 39 with the number of spiral rotations set to 0.75 rotation is used and a second transmission line 32*b* is formed, as shown in the schematic view of FIG. 5. Even in cases where such a number of spiral rotations is set, the line length of the second transmission line 32*b* can be set larger as compared with the line length of the first transmission line, so that the effective dielectric constant $\in$2 of the second transmission line 32*b* can be made larger than the effective dielectric constant $\in$1 of the first transmission line.

In addition, in such a transmission line, the setting for the number of spiral rotations in the rotational-direction reversal structure may be selected as an optimum value for obtainment of desired characteristics under the limitation of the circuit occupation area. For example, if the number of spiral rotations is set to within a range of about 0.5 rotation to 1.5 rotations, then the above-described effects of the invention can be obtained under a setting of the circuit occupation area, favorably. Also, in a method in which such rotational-direction reversal structure 29, 39 is adopted for the second transmission line 22*b*, 32*b*, the transmission direction of the signal to be transmitted in the second transmission line 22*b*, 32*b* can be locally led toward a direction different from the signal transmission direction in the first transmission line 22*a*. As a result of this, the continuity of the current loop associated with the transmission line can be locally cut off, the amount of coupling with an adjacently placed transmission line due to the mutual inductance can be reduced. That is, not only the white noise effect for the crosstalk signal can be obtained by the generation of an effective dielectric constant difference, but also the crosstalk signal intensity caused by the coupled line structure per unit length can be suppressed. Thus, there is obtained an additional effect that not only spike noise sharper is dissipated in the crosstalk waveform to make the waveform into white noise, but also the intensity of the crosstalk signal can be effectively suppressed.

As shown in FIG. 4B, in the rotational-direction reversal structure 29 of the second transmission line 22*b*, the transmission-direction reversal section (transmission-direction reversal region or transmission-direction reversal structural portion) 97 for locally transmitting the signal toward a direction which differs from the signal transmission direction 96 by more than 90 degrees is included in the structure. That is, signal transmission directions in the respective first semicircular-arc structures 27*a*, 28*a* located in close proximities to the center of the rotational-direction reversal structure 29 are those differing from the transmission direction 95 by more than 90 degrees and further including a direction reversed by 180 degrees. Therefore, in the rotational-direction reversal structure 29, a structural portion formed by the first semicircular-arc structures 27*a*, 28*a* forms the transmission-direction reversal section 97.

Thus, in the second transmission line 22*b*, in which a structure including the transmission-direction reversal section 97 is adopted, a far-end crosstalk signal generated from a signal traveling along the first transmission line 22*a* travels in a direction opposite to the direction of a normal far-end crosstalk signal (i.e., transmission direction 95), in the transmission-direction reversal section 97. That is, the setting of the transmission-direction reversal section 97 has a function of canceling a normal crosstalk signal. Accordingly, by the inclusion of the transmission-direction reversal section 97 in the rotational-direction reversal structure 29, the crosstalk suppression effect can be further increased. It is noted that, herein, the terms "reverse the transmission direction" refer to, in FIG. 4B, making a negative x-direction component generated in a vector in a local signal transmission direction in the transmission line, where the transmission direction 95, 96 is assumed as the X-axis direction and a direction orthogonal to this X-axis direction is assumed as the Y-axis direction.

Figure 5:
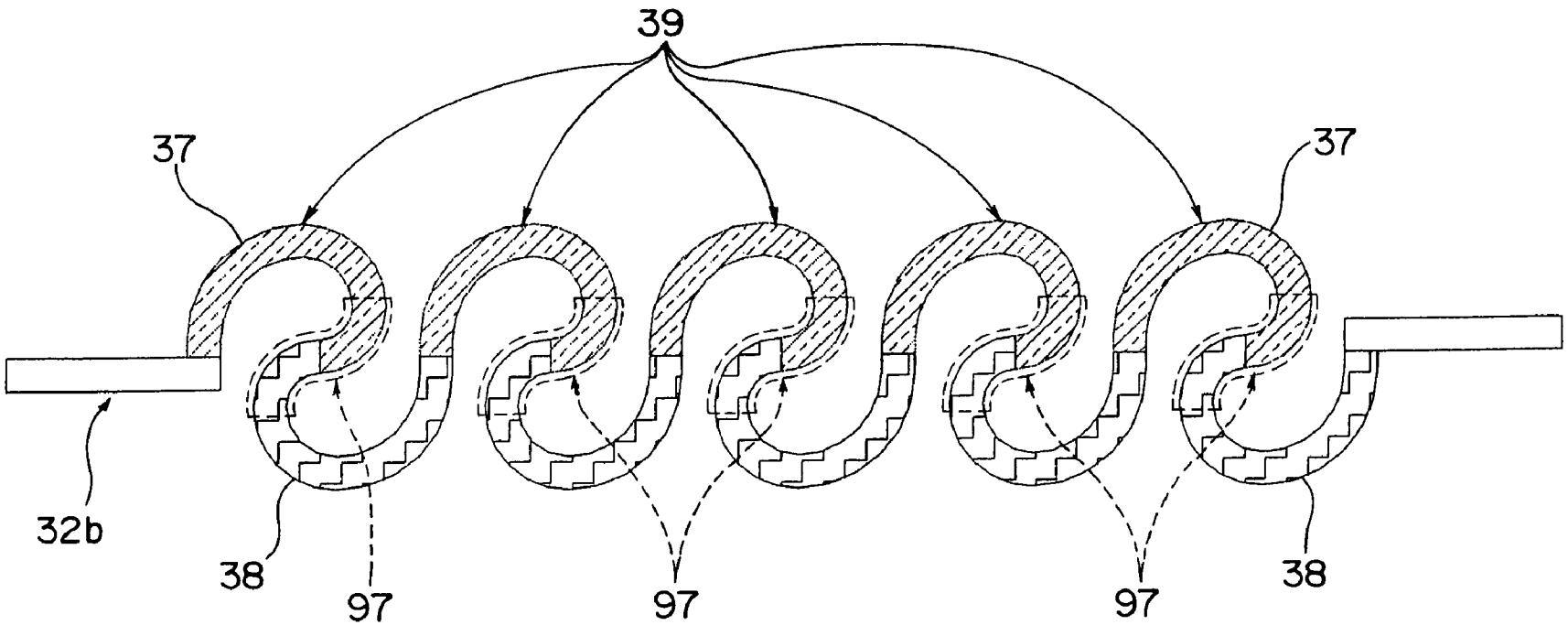
FIG. 5 is a schematic plan view showing a second transmission line in a transmission line pair according to a modification of the foregoing embodiment (with the number of spiral rotations being 0.75 rotation)

Further, also in the rotational-direction reversal structure 39 of the second transmission line 32*b* shown in FIG. 5, the transmission direction of the transmitted signal is reversed by more than 90 degrees with respect to the transmission direction 95 in the first transmission line 22*a*, including a portion reversed up to 180 degrees, where it can be said that the transmission-direction reversal section is included. More specifically, the rotational-direction reversal structure 39 of FIG. 5 is so made up that a curved signal conductor 37 curved along the first rotational direction and a curved signal conductor 38 curved toward the second rotational direction opposite to the first rotational direction are electrically connected to each other, where the transmission-direction reversal section 97 enclosed by broken line is formed by the signal conductor in proximity to their connecting portion so that the signal transmission direction is reversed at this section. In addition, although not shown, each of the curved signal conductors 37 and 38 is formed by a combination of two types of partial circular-arc structures having different curvatures of their curves.

Figure 6:
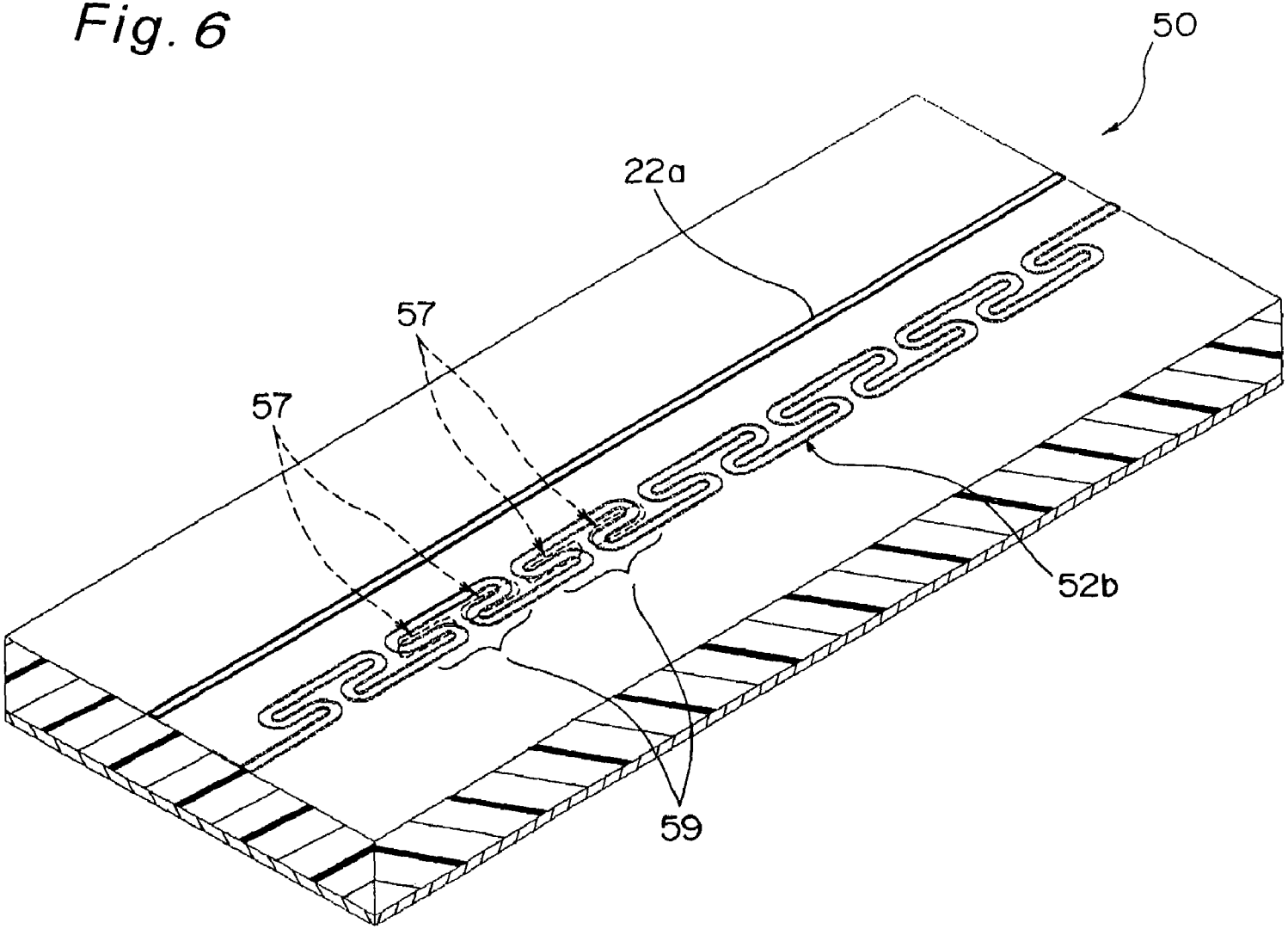
FIG. 6 is a schematic perspective view of a transmission line pair according to a modification of the embodiment.

Further, in a transmission line pair 50 shown in FIG. 6 by a schematic perspective view, since a multiplicity of transmission-direction reversal sections 57 (partly defined and indicated by broken line) are included in the structure, so that the effect by the inclusion of the transmission-direction reversal sections 57 can be obtained more effectively. In addition, the crosstalk intensity suppression effect becomes the largest when the local signal transmission direction of the signal conductor of the second transmission line is strictly reverse to the signal transmission direction 95 (i.e., reversed by 180 degrees), which is more preferable, but the crosstalk intensity suppression effect can partly be obtained if a section having an angle more than 90 degrees to the signal transmission direction 95.

However, the placement of the signal conductor in a second transmission line 52*b* of FIG. 6 may cause unnecessary reflection to high-speed signals. That is, in a comparison of the structure size under the condition that the transmission line pairs 20 and 50 are equal in line width setting to each other in FIG. 4A and FIG. 6, the effective line length of the rotational-direction reversal structures 29 and 59 is longer in the structure of FIG. 6 than in the structure of FIG. 4A. Like this, as the effective line length of the rotational-direction reversal structure 59 becomes longer, the resonance frequency in the structure becomes lower, so that unfavorable phenomena such as reflection and radiation tend to occur increasingly in frequency bands near the resonance frequency. In order to reduce the occurrence of such unfavorable phenomena, it is preferred that the effective line length of the rotational-direction reversal structure, which is to be set in the signal conductor of the second transmission line, is so set as to be less than a half of the effective wavelength of the transmission frequency.

In the rotational-direction reversal structure 59 in the signal conductor of the second transmission line 52*b* of FIG. 6, the curved signal conductor curved along the first rotational direction and the curved signal conductor curved along the second rotational direction are formed with the curvature of their curves set constant, and formed not by a combination of two types of partial circular-arc structures having different curvatures of curves like the curved signal conductors 27, 28, 37 and 38 in the transmission lines of FIG. 4B and FIG. 5. Further, curved signal conductors of mutually different rotational directions are electrically connected to each other via linear signal conductors. That is, in the rotational-direction reversal structure 59, each of the transmission direction reversal sections 57 is composed of part of its own curved signal conductor and the linear signal conductor, where the effect by the setting of the transmission-direction reversal section as shown above can be obtained in such a structure.

Also, the configuration of the second transmission line is not limited to a configuration meandering in symmetrical directions with respect to the center axis of the line, e.g., a configuration having an S-like shape, but also may be a configuration curved only in one direction in the symmetrical directions, e.g., a configuration having a C-like shape.

Further, the transmission lines 22*a* and 22*b* of this embodiment are not limited to the case where the signal conductors 23*a* and 23*b* are formed on the topmost surface of the circuit board (dielectric substrate) 21, but also may be formed on an inner-layer conductor surface (e.g., inner-layer surface in a multilayer-structure board) Similarly, the grounding conductor layer 5 as well is not limited to the case where it is formed on the bottommost surface of the circuit board 21, but also may be formed on the inner-layer conductor surface. That is, herein, one face (or surface) of the board refers to a topmost surface or bottommost surface or inner-layer surface in a board of a single-layer structure or in a board of a multilayer-structure.

Figure 26:
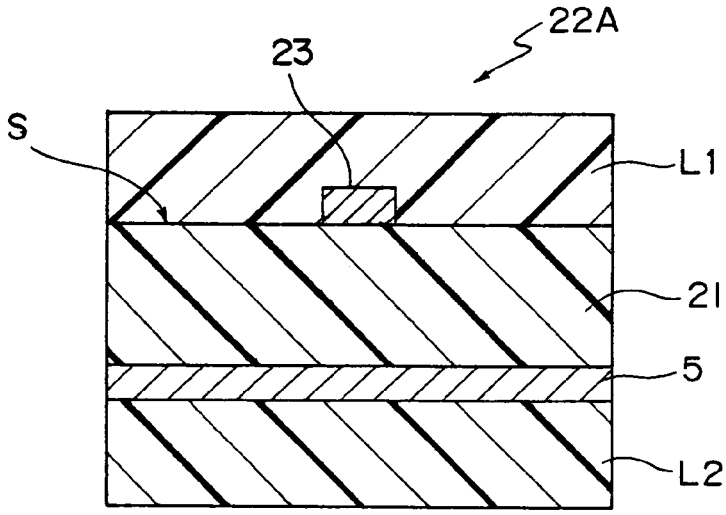
FIG. 26 is a schematic sectional view showing a structure in which another dielectric layer is placed on the top face of the circuit board in the transmission line of the foregoing embodiment.
Figure 27:
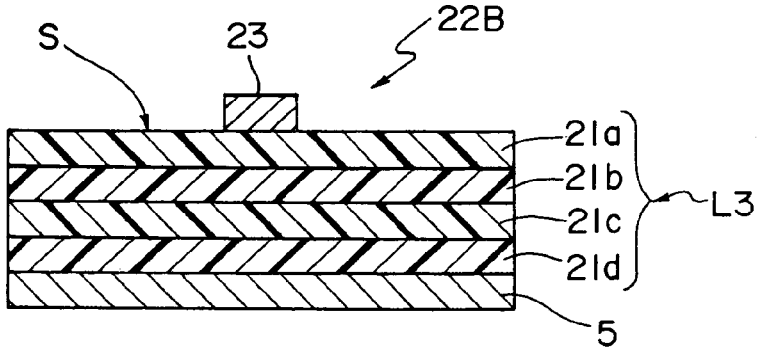
FIG. 27 is a schematic sectional view showing a structure in which the circuit board is a multilayer body in the transmission line of the foregoing embodiment.
Figure 28:
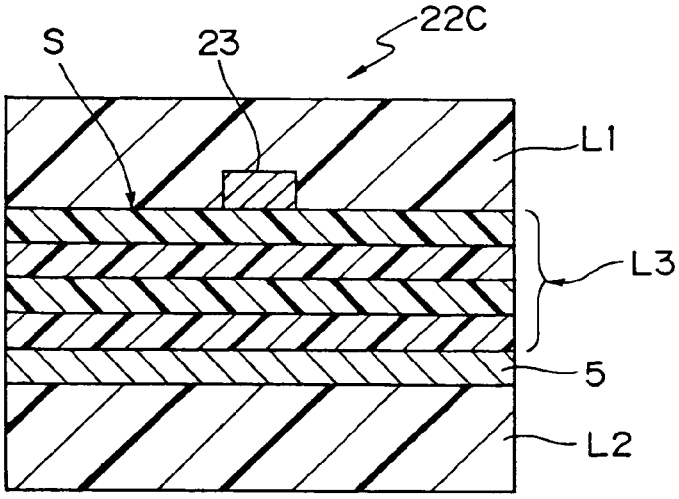
FIG. 28 is a schematic sectional view showing a structure in which the transmission line of FIG. 26 and the transmission line of FIG. 27 are combined together in the transmission line of the foregoing embodiment.

More specifically, as shown in a schematic sectional view of a transmission line 22A of FIG. 26 (i.e., a schematic sectional view showing only one transmission line out of two transmission lines constituting a transmission line pair, which hereinafter applies similarly to FIGS. 27 and 28), the structure may be that a signal conductor 23 is placed on one face (upper face in the figure) S of the circuit board 21 while a grounding conductor layer 5 is placed on the other face (lower face in the figure), where another dielectric layer (another circuit board) L1 is placed on the one face S of the circuit board 21 while still another dielectric layer (still another circuit board) L2 is placed on the lower face of the grounding conductor layer 5. Further, like a transmission line 22B shown in a schematic sectional view of FIG. 27, the case may be that the circuit board 21 itself is formed as a multilayer body L3 composed of a plurality of dielectric layers 21*a*, 21*b*, 21*c* and 21*d*, where a signal conductor 23 is placed on one face (upper face in the figure) of the multilayer body L3 while a grounding conductor layer 5 is placed on the other face (lower face in the figure). Furthermore, it is also possible that, like a transmission line 22C shown in FIG. 28 having a structure in combination of the structure shown in FIG. 26 and the structure shown in FIG. 27, another dielectric layer L1 is placed on one face S of the multilayer body L3 while still another dielectric layer L2 is placed on the lower face of the grounding conductor layer 5. In any of the transmission lines 22A, 22B and 22C of the structures of FIGS. 26 to 28, the surface denoted by reference mark S serves as the "surface (one face) of the board."

Also, in the transmission line pair of the foregoing embodiment, in order to further effectively set such an effective dielectric constant difference that $\in 1 < \in 2$ between the effective dielectric constant $\in 1$ of the first transmission line and the effective dielectric constant $\in 2$ of the second transmission line having the transmission-direction reversal section, it is also possible that an additional dielectric which is an example of a proximity dielectric formed from a dielectric material on the surface of the second signal conductor in the second transmission line is placed in a partial region so that the effective dielectric constant $\in 2$ of the second transmission line is further enhanced as compared with $\in 1$ by virtue of the placement. By doing so, the crosstalk intensity suppression effect can be obtained further effectively. The placement of such an additional dielectric is not limited to the case where it is placed so as to cover the surface of the second signal conductor as shown above. Otherwise, the effect of enhancement of the effective dielectric constant $\in 2$ in comparison to ∈1 can be obtained also when the additional dielectric is placed so as to cover part of the surface of the second signal conductor, or so as not to cover the surface of the second signal conductor but to be placed closer to the second signal conductor than to the first signal conductor.

In the transmission line pair according to the embodiment described above, it is preferable that a signal of a larger transmission speed is transmitted along the first transmission line while a signal of a lower transmission speed is transmitted along the second transmission line. The first transmission line has an effective dielectric constant set lower as in conventional transmission lines, so that signal delay is suppressed by such a setting, but nevertheless, since a crosstalk-resistant characteristic, which could not be obtained in conventional transmission lines, can be obtained, the first transmission line can be said to be suitable for high-speed transmission.

Figure 7:
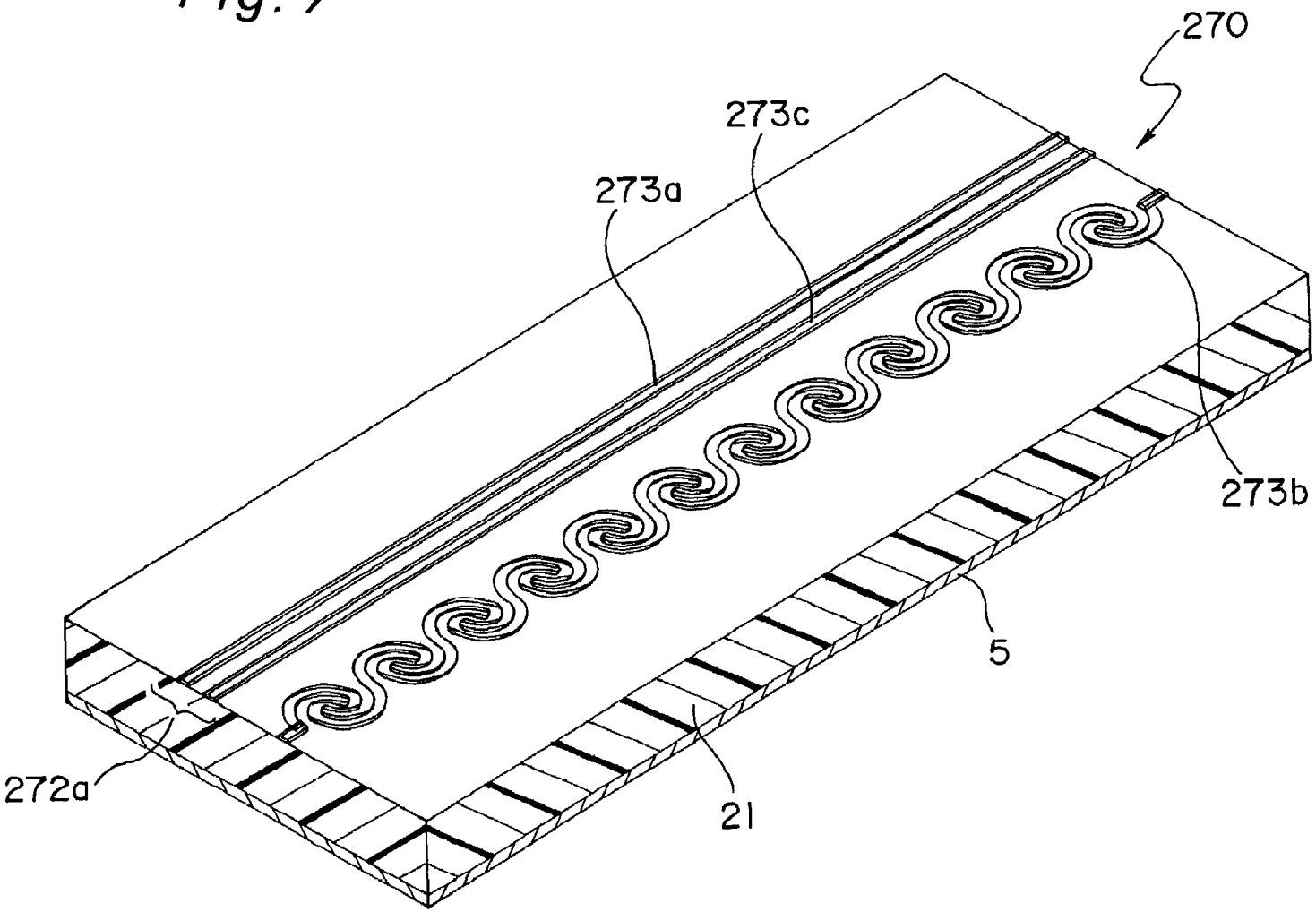
FIG. 7 is a schematic perspective view showing the structure of a transmission line pair according to a modification of the embodiment, where the first transmission line is a differential line.

Also, in the transmission line pair of the foregoing embodiment, as in a transmission line pair 270 exemplified by the schematic perspective view of FIG. 7, a first transmission line 272*a* may be formed as a differential transmission line including two signal conductors 273*a*, 273*c* so as to be paired with a second signal conductor 273*b* of a second transmission line 272*b* as the transmission line pair 270. In such cases as the first transmission line 272*a* performs differential transmission, there can be provided a transmission line pair which is more excellent in crosstalk-resistant characteristic than the second transmission line 272*b* and suitable for high-speed transmission.

Further, in the transmission line pair according to the foregoing embodiment, instead of the case where the second transmission line is used for transmission of signals of lower transmission speed, the second transmission line may be used as a bias line for supplying DC voltage to active elements within the circuit. Generally, such a bias line is in many cases formed so as to be inductive, i.e., formed with a thin signal conductor width, thus having an advantage that making the signal conductor meandering does not cause so much increase in circuit occupation area. Besides, when the principle of the invention is applied to a bias line having a characteristic that signal delay characteristics do not matter but the coupling with peripheral transmission lines often matters, the effects of the invention can be obtained more effectively in radio-frequency circuits.

Further, as a desirable condition for the transmission line pair of the invention, it is most preferable that such a dielectric-constant difference setting region that ∈1<∈2 be formed over the entirety of a coupled line region, which is a coupling portion between the first transmission line and the second transmission line placed in adjacency and couplability to the first transmission line. Besides, even when the dielectric-constant difference setting region is not formed over the entirety of the coupled line region as shown above, it is preferable that a portion of the coupled line region corresponding to at least 50% or more of the coupled line length Lcp be set as the dielectric-constant difference setting region.

Even if a plurality of dielectric-constant difference non-setting regions where ∈1=∈2 are present in the coupled line region and if its total region length (or line length) occupies a length corresponding to 50% or more of the coupled line length Lcp, it is preferable that dielectric-constant difference setting regions are placed at positions where individual dielectric-constant difference non-setting regions are segmented and that a region length Lcp1 of a dielectric-constant difference non-setting region that is formed continuously over the largest length among the individual dielectric-constant difference non-setting regions is set to at least less than 50% of the coupled line length Lcp.

Also, preferably, the region length Lcp1 of the dielectric-constant difference non-setting region measures less than a half of the effective wavelength λg1 of the transmission frequency in the first transmission line. A crosstalk signal generated in the region of the region length Lcp1 of the dielectric-constant difference non-setting setting region inevitably causes crosstalk characteristics similar to those of conventional transmission line pairs, no matter how high an effective dielectric constant difference is set in regions before and after the dielectric-constant difference non-setting region. Therefore, the crosstalk generated in the region defined by the region length Lcp1 of the dielectric-constant difference non-setting region has a high-pass characteristic, so that the waveform of the crosstalk results in spike noise having a sharp peak. This is the reason the region length Lcp1 of the dielectric-constant difference non-setting region is preferably set as short as possible. In addition, even in cases where the total region length of the dielectric-constant difference non-setting region has to be set longer due to limitations of circuit placement or occupation area, it is preferable that a dielectric-constant difference setting region is inserted between dielectric-constant difference non-setting regions and that the region length Lcp1 of the succeeding dielectric-constant difference non-setting regions is set short. Besides, sections where the interval between the two transmission lines is varied due to the bent placement of lines are not included in part of the coupled line length Lcp in the description of the invention, and does not form the coupled line region. Furthermore, if an effective dielectric-constant inversion region where ∈1>∈2 is partly formed, the effect obtained in the proper region where ∈1<∈2 would be canceled out, hence undesirable.

Also, in the transmission line pair of the foregoing embodiment, the structure may be a delay structure such as a rotational-direction reversal structure for the second transmission line in which a signal is locally led far around, or a structure including an intentional delay structure using introduction of an additional dielectric into the transmission line structure. In these delay structures, preferably, such rotational-direction reversal structures as can realize the highest effective dielectric constant difference are connected to one another cyclically in series, or structures formed of dielectrics having the same cross-sectional structure are set in succession. However, the effects of the present invention can be obtained without being lost even in cases where the structural parameters such as the number of rotations or line width are set to different conditions or where delay structures that give different effective dielectric constant differences depending on the settings of different cross-sectional structures are connected to one another. Nevertheless, since the characteristics depend largely on the dielectric constant different setting in the region where the effective dielectric constant difference is set to the lowest, the region length Lcp1 corresponding to the length over which the section in which the effective dielectric constant difference is set low continues is preferably set to less than a half of the coupled line length Lcp.

Also, two delay structures may be connected to each other by a normal linear transmission line. However, it is preferable that the region length Lcp1, over which the dielectric-constant difference non-setting region continues, is set, similarly, to a length less than a half of the coupled line length Lcp. The condition that allows the highest effect to be obtained with the structure of the present invention is given by a structure in which a value continuously uniform over the entirety of the coupled line region has been achieved as the effective dielectric constant ∈2 of the second transmission line, so that the length Lcp1 of the section over which the dielectric-constant difference non-setting region continues needs to be limited as short as possible.

However, at sections where, for example, the transmission line is bent, there are some cases, actually, where it is difficult to realize the structure of the present invention continuously.

Figure 8:
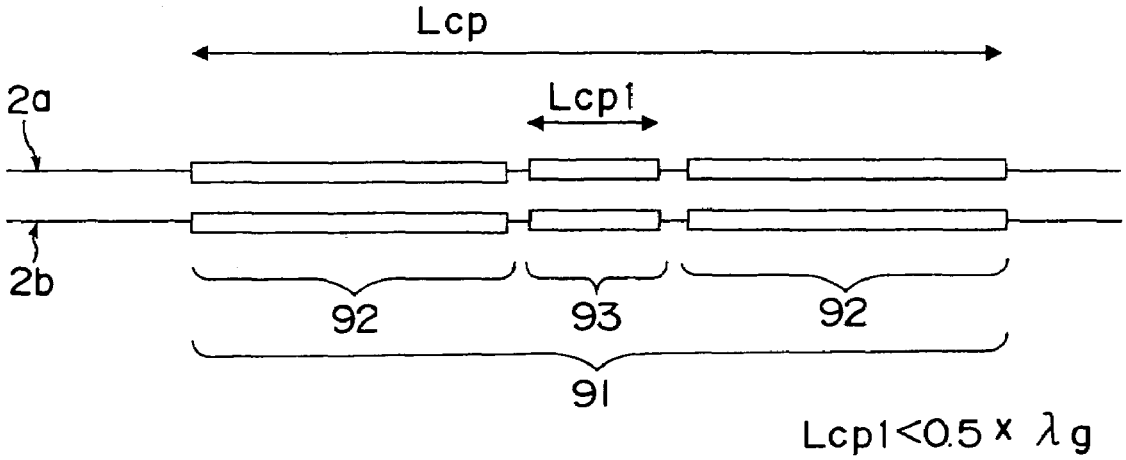
FIG. 8 is a schematic explanatory view showing a transmission line pair according to a preferred embodiment of the present invention, showing a state that a dielectric-constant-difference non-set region is placed between dielectric-constant-difference set regions.

In this case, as there arises a dielectric-constant difference non-setting region 93 where the increasing rate in value of the effective dielectric constant ∈2 of the second transmission line with respect to the effective dielectric constant ∈1 of the first transmission line vanishes in some sections, it is preferable that the region length Lcp1 of the dielectric-constant difference non-setting region 93 is set to a non-resonant state in the transmission signal frequency. That is, as shown in the schematic explanatory view of FIG. 8, in the case where a dielectric-constant difference setting region 92 and a dielectric-constant difference non-setting region 93 are present in the coupled line region 91, the region length Lcp1 of the dielectric-constant difference non-setting region 93 is preferably set to meet a condition shown by Equation 9:

$$Lcp1<0.5\times\lambda g(=\lambda/\sqrt{(\in 1)}) \quad \text{(Eq. 9)}$$

where λg in Equation 9 represents an effective wavelength of the transmission signal frequency in the first transmission line.

Further, setting the region length Lcp1 of the dielectric-constant difference non-setting region to less than a half of the effective wavelength λg is a condition effective also for avoiding any increase in crosstalk intensity in the dielectric-constant difference non-setting region 93 where the crosstalk suppression effect vanishes as well as the formation of any sharp spike noise.

Figure 9A:
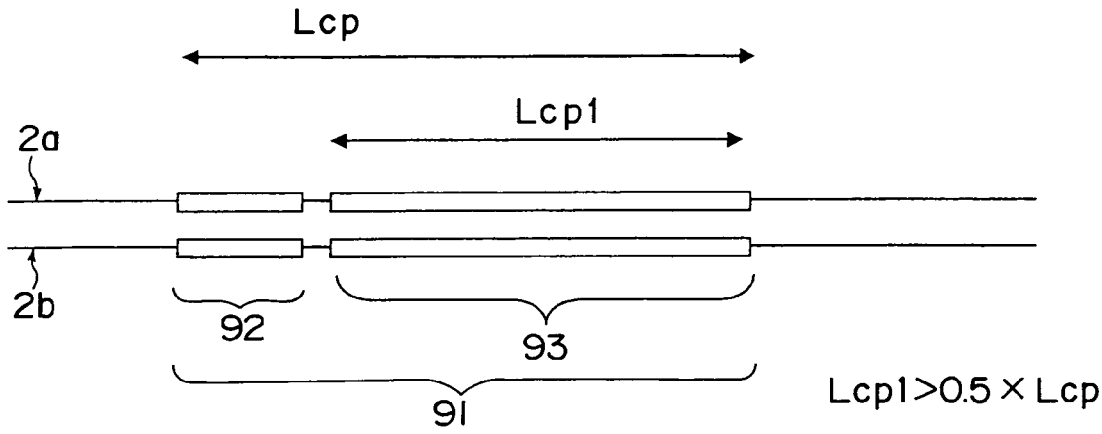
FIG. 9A is a schematic explanatory view showing a transmission line pair according to a non-preferred embodiment of the present invention, showing a state that a dielectric-constant-difference non-set region is placed over not less than 50% of the coupled line length.
Figure 9B:
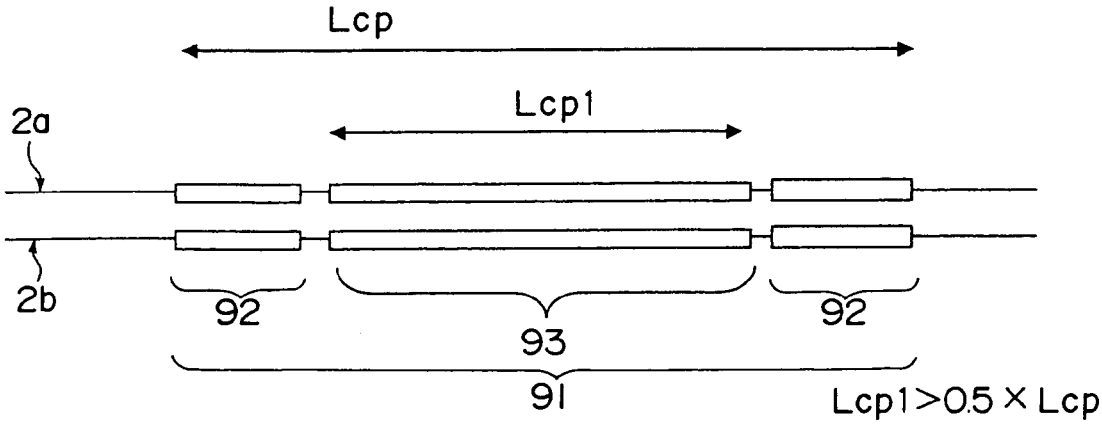
FIG. 9B is a schematic explanatory view showing a schematic explanatory view showing a transmission line pair according to a non-preferred embodiment of the present invention, showing a state that a dielectric-constant-difference non-set region is placed over not less than 50% of the coupled line length.

Schematic explanatory views of undesirable embodiments are shown in FIGS. 9A and 9B. As shown in FIGS. 9A and 9B, it is undesirable that a section measuring 50% or more of the overall line length of the coupled line region 91, i.e. to the overall coupled line length Lcp, is continuously set as the dielectric-constant difference non-setting region 93. In such a case, it becomes difficult to remove any sharp peaks from the crosstalk waveform.

Figure 10:
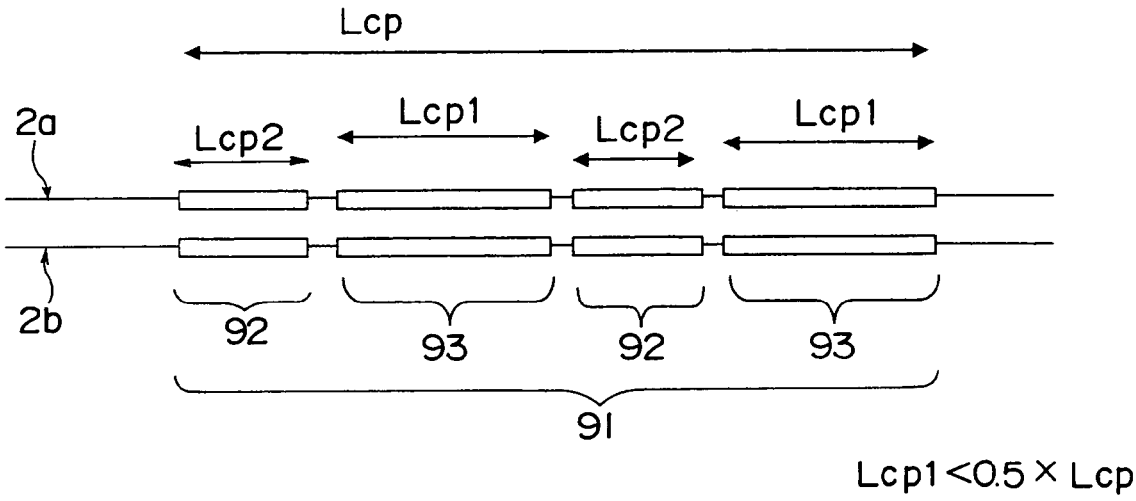
FIG. 10 is a schematic explanatory view showing a transmission line pair according to a preferred embodiment of the present invention, showing a state that the region length of one dielectric-constant-difference non-set region is less than 50% of the coupled line length.

However, as shown in FIG. 10, in such a case as a half or more of the coupled line length Lcp is occupied by the dielectric-constant difference non-setting regions 93, it is possible enough to obtain the effects of the present invention only if the region length Lcp1 over which one dielectric-constant difference non-setting region 93 continues is not a half or more of the coupled line length Lcp with respect to the individual dielectric-constant difference non-setting regions 93. This is a condition based on the principle that even though crosstalk signals of a sharp peak are generated in two dielectric-constant difference non-setting regions 93, respectively, the intensity of the generated crosstalk signals can be lowered if the timing at which the two signals are superimposed on each other is shifted in time order from each other. In this case, with respect to the dielectric-constant difference setting region 92 interposed between two dielectric-constant difference non-setting regions 93, it is preferable that its region length Lcp2 is a half or more of the effective wavelength λg in the transmission frequency and moreover that a condition shown by Equation 10 holds with respect to an effective line length difference ΔLeff2 also within one dielectric-constant difference setting region 92:

$$\Delta Leff2=Lcp2\times\{\sqrt{(\in 2)}-\sqrt{(\in 1)}\} \quad \text{(Eq. 10)}$$

In addition, there is a conventional transmission line pair in which a delay structure is adopted in part of one transmission line as a circuit structure that might be misconstrued as similar to the transmission line pair of the present invention at first sight. However, in such a conventional transmission line pair, the aim of introducing the delay structure into one transmission line is to adjust the timing of signals transmitted along one pair of transmission lines, which is absolutely different in aim and principle from the transmission line pair of the present invention. Therefore, in the conventional transmission line pair, an optimum structure with considerations given to the principle of the invention described in the foregoing embodiment is not adopted at all.

Figure 11A:
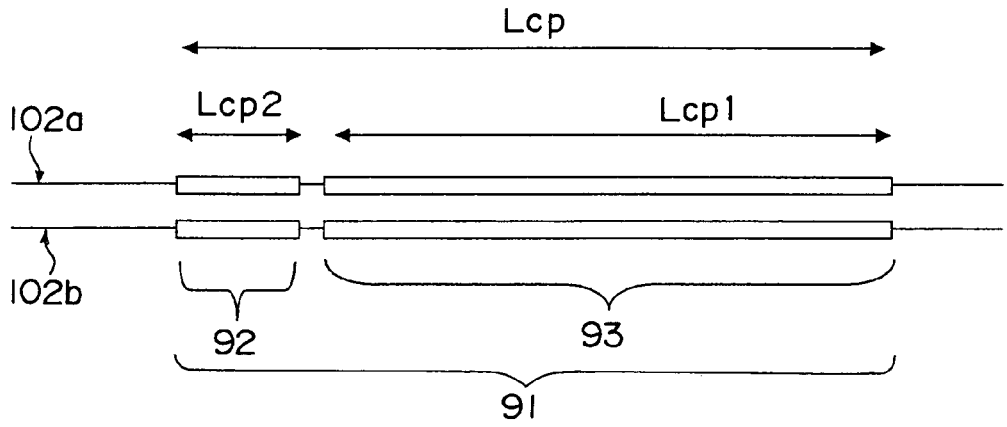
FIG. 11A is a schematic explanatory view showing the structure of a transmission line pair that might be misconstrued as similar to the present invention, showing a state that a signal delay structure is placed at a local section of the coupled line region.

For instance, in such a transmission line pair shown in a schematic explanatory view of FIG. 11A, two transmission lines 102*a*, 102*b* each have a linear shape at almost all sections of a coupled line region 91, where there may be cases where a meandering structure of signal conductors is introduced in order that only either one of the transmission lines gains a delay amount concentratedly at some sections. However, such a transmission line pair, although including a delay structure in its structure, yet differs in both aim and structure from the transmission line pair of the present invention, structurally incapable of effectively obtaining the effective of the present invention. Also when the effective dielectric constant difference in the dielectric-constant difference setting region 92 is set to a large numerical value, the structure has no essential difference from the construction shown in the schematic explanatory view of the undesirable structure of FIG. 9A, thus incapable of effectively obtaining the effect of the present invention. In contrast to this, the transmission line pair of the present invention obtains an advantageous effect by the arrangement that the meandering structure introduced into the signal conductor of the second transmission line is distributively placed in the coupled line region.

Figure 11B:
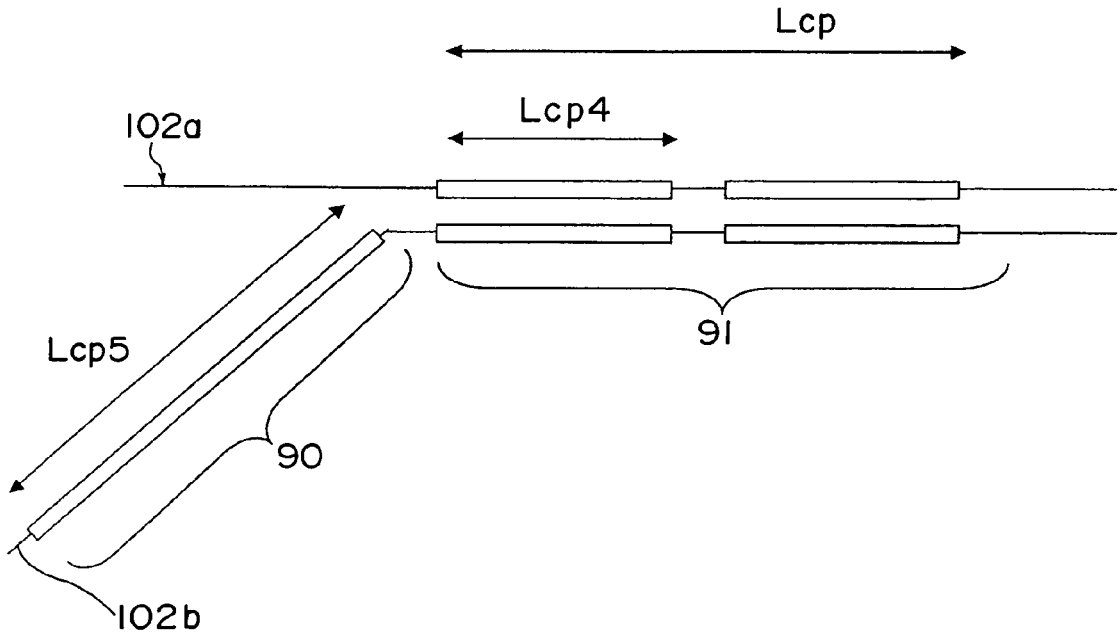
FIG. 11B is a schematic explanatory view showing the structure of a transmission line pair that might be misconstrued as similar to the present invention, showing a state that a signal delay structure is placed at a section where the coupling is released.

Further, also in a transmission line pair in which a section where the effective dielectric constant increases with a meandering structure of a transmission line stretches over a long distance, in the case where a region length Lcp4 over which the effective dielectric constant difference is set in a circuit having continuing meandering of the transmission line, particularly in the coupled line region 91, not only in the coupled region 91, which is the section where the two transmission lines 102*a*, 102*b* are coupled together, but also in the region 90 where the coupling is released as in the transmission line pair shown in the schematic explanatory view of FIG. 11B is shorter than a region length Lcp5 over which the effective dielectric constant difference is set in the region 90 other than the coupled region 91, it can be said that the aim of making the transmission lines meandering is to fulfill the timing adjustment for signal delay. Thus, the structure is not aimed at the effect of the present invention, and absolutely differs from that of the transmission line pair of the present invention.

Next, in conjunction with the transmission line pair according to the embodiment described above, its constitution and effects obtained therefrom will concretely be described below by way of embodiments thereof.

WORKING EXAMPLE 1

First, as Working Example 1, a signal conductor having a thickness of 20 μm and a wiring width W of 100 μm was formed on a top face of dielectric substrate having a dielectric constant of 3.8 and a total thickness of 250 μm by copper wiring, and a grounding conductor layer having a thickness of 20 μm was formed all over on a rear face of the dielectric substrate similarly by copper wiring. Thus, a parallel coupled microstrip line structure having a coupled line length Lcp of 50 mm was made up. It is noted that the values shown above are the same as those of the radio-frequency circuit of Prior Art Example 1. The input terminal is connected to a coaxial connector, and an output-side terminal is terminated for grounding with a resistor of 100 Ω, which is a resistance value nearly equal to the characteristic impedance, so that any adverse effects of signal reflection at terminals were reduced. In the second transmission line, a top view is shown in FIG. 5, a signal conductor was placed in a spiral shape of 0.75 rotation so that a signal is meandered alternately in reverse directions. A total wiring width W2 of the second signal conductor of the second transmission line was set to 500 μm. The first signal conductor of the first transmission line was linear shaped. By reducing the wiring region distance G of those signal conductors was reduced from 650 μm of Prior Art Example 1 to 450 μm, by which a wiring distance of 750 μm, equal to the wiring distance D in the transmission line pair of Prior Art Example 1 was fulfilled also in Working Example 1.

Figure 12:
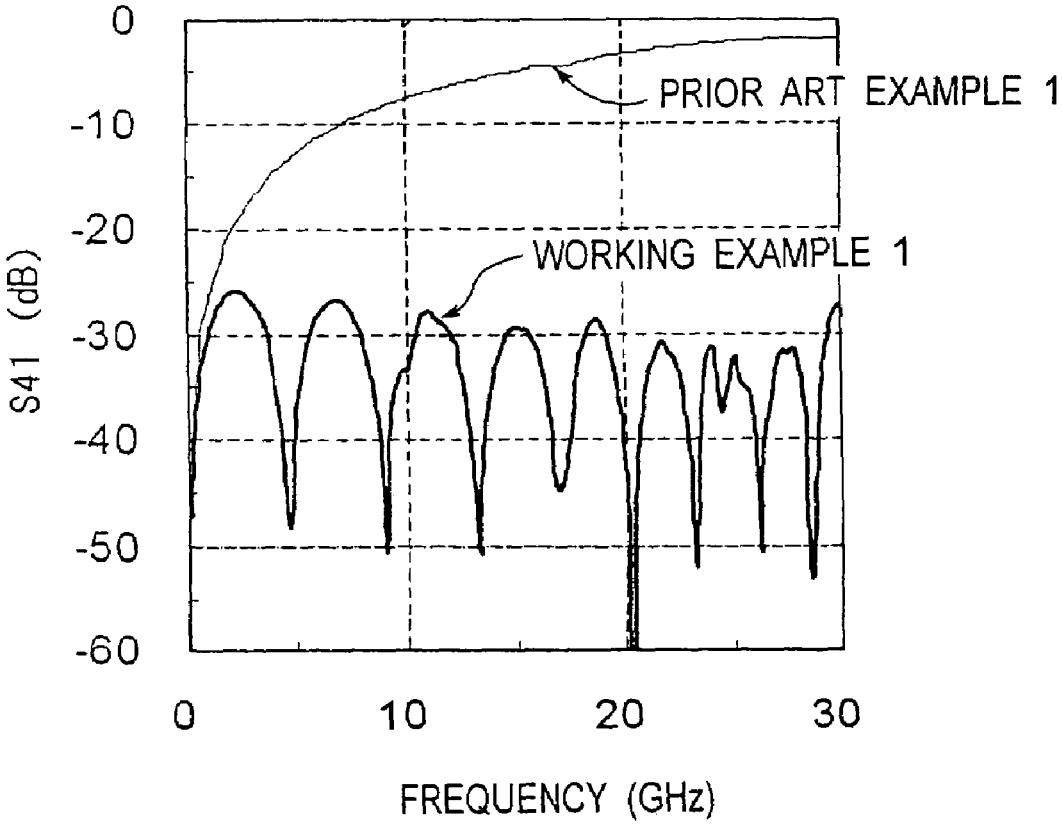
FIG. 12 is a view in the form of a graph showing, in comparison, the frequency dependence of crosstalk intensity between a transmission line pair according to Working Example 1 of the foregoing embodiment and a transmission line pair of Prior Art Example 1.

Now, a crosstalk characteristic in the transmission line pair of Working Example 1 and a crosstalk characteristic in the transmission line pair of Prior Art Example 1 are shown in FIG. 12 in a comparison-enabled manner. It is noted that in FIG. 12, the vertical axis represents crosstalk characteristic while the horizontal axis represents frequency. As apparent from a comparison of crosstalk characteristic between Working Example 1 and Prior Art Example 1 shown in FIG. 12, isolation characteristics obtained in Working Example 1 were more successful than those in Prior Art Example 1 over the entire frequency band of measurement, by which the advantageous effects of the present invention were able to be verified.

Further, effective dielectric constants of the individual transmission lines derived from transit phase characteristics were 2.41 in the first transmission line and 6.77 in the second transmission line. In particular, an apparent improvement over Prior Art Example 1 was obtained in a frequency band of 2.3 GHz or higher. More specifically, whereas the crosstalk intensity monotonously increased with increasing frequency in Prior Art Example 1, the crosstalk intensity turned to decrease in a frequency band of 2.3 GHz or higher in Working Example 1. At the frequency of 2.3 GHz where the effective line length difference ΔLeff corresponds to 0.5 time the wavelength λ, the crosstalk intensity was −20 db in Prior Art Example 1, and −26 db in Working Example 1. Also, at a frequency of 4.6 GHz where the effective line length difference ΔLeff coincides with the wavelength λ, the crosstalk intensity was −13 db in Prior Art Example 1, while it was able to be suppressed to −48 db in Working Example 1. In addition, even in frequency bands of 4.3 GHz or higher, although the crosstalk intensity reached a maximum value at frequencies of 6.9 GHz and 10.8 GHz, which are nearly odd-multiples of the frequency of 2.3 GHz where the effective line length difference ΔLeff corresponds to 0.5 time the wavelength λ, yet crosstalk suppression effects as much as 15 db and 19 dB, respectively, were obtained in comparison to Prior Art Example 1. Also, the crosstalk intensity cyclically reached a minimum value at frequencies of 8.9 GHz and 13.3 GHz, which are nearly integral-multiples of the frequency of 4.6 GHz where the effective line length difference ΔLeff corresponds to the wavelength λ, in which case rapid crosstalk suppression effects as much as 41 db and 44 db, respectively, were obtained in comparison to Prior Art Example 1.

Figure 13:
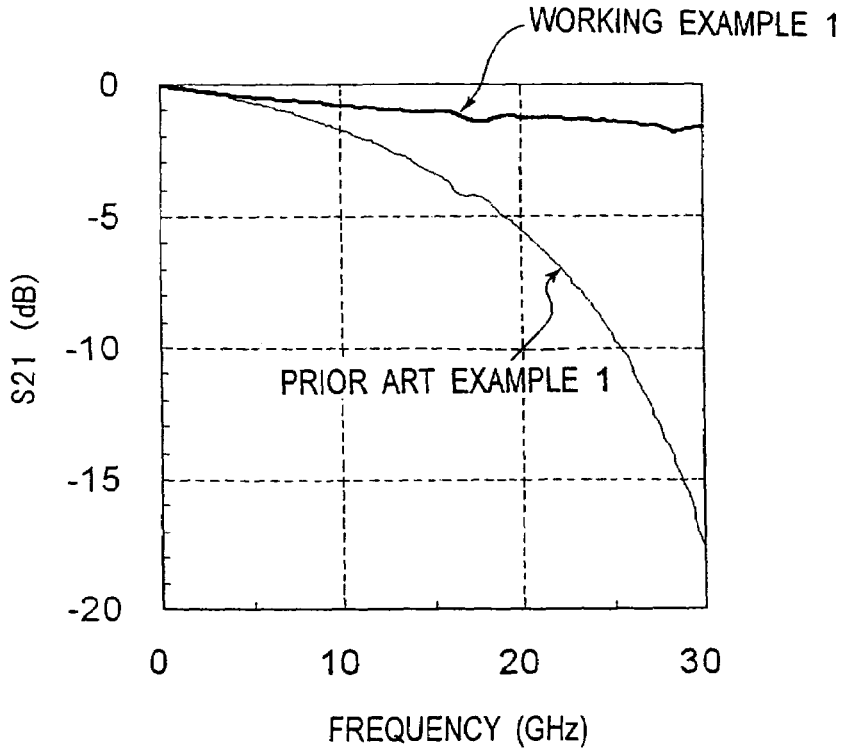
FIG. 13 is a view in the form of a graph showing, in comparison, the frequency dependence of transit intensity characteristics between the transmission line pair of Working Example 1 and the transmission line pair of Prior Art Example 1.

Further, a comparison of transit intensity of the first transmission line in Prior Art Example 1 and Working Example 1 is shown in FIG. 13. The transit intensity of Prior Art Example 1 was −0.313 db at 2.3 GHz, whereas the first transmission line of Working Example 1 showed a value of −0.106 db, hence an improvement, and from this on, the degree of improvement monotonously increased with increasing frequency, where at a frequency of 25 GHz as an example, the first transmission line of Working Example 1 maintained a transit intensity of −1.5 db while that of Prior Art Example 1 showed a transit intensity of −9.5 db.

Although not shown, even the second transmission line of Working Example 1, which might well deteriorate in transit intensity characteristics with the effective dielectric constant increased, showed an excelling effect for transit characteristic sustainment by crosstalk suppression in frequency bands of 8 GHz or higher so as to excel the transit intensity characteristic of Prior Art Example 1. More specifically, at a frequency of 10 GHz as an example, transmission line pair transmission line of Working Example 1 showed a transit intensity of −1.55 db while that of Prior Art Example 1 showed a transit intensity of −1.74 db. At a frequency of 25 GHz, the second transmission line of the Working Example 1 was able to maintain a transit intensity of −2.8 db, while that of Prior Art Example 1 showed a transit intensity of −9.5 db.

Figure 14:
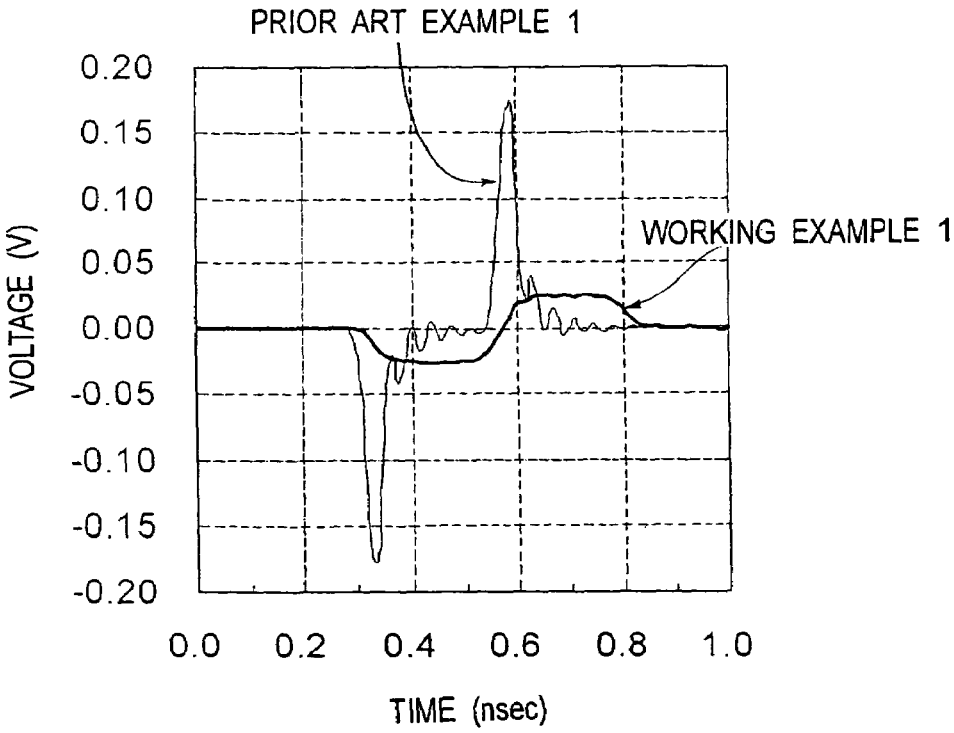
FIG. 14 is a view in the form of a graph showing, in comparison, the crosstalk voltage waveform observed at the far-end crosstalk terminal upon application of a pulse to the transmission line pair of Working Example 1 and the transmission line pair of Prior Art Example 1.

Furthermore, a pulse with a voltage of 1 V and a rise/fall time of 50 picoseconds was applied in Working Example 1, as in Prior Art Example 1, and crosstalk waveform at their far-end crosstalk terminals was measured. A comparison of crosstalk waveform between Working Example 1 and Prior Art Example 1 is shown in FIG. 14. In FIG. 14, the vertical axis represents voltage while the horizontal axis represents time. Whereas a crosstalk voltage having an intensity of 175 mV was generated in Prior Art Example 1 as indicated by thin line in FIG. 14, the crosstalk intensity was able to be suppressed to 30 mV in Working Example 1. Besides, as apparent from the figure, the crosstalk waveform in Working Example 1 resulted in a gentle white noise-like waveform without be accompanied by any sharp peak on the time base.

WORKING EXAMPLE 2

Figure 15:
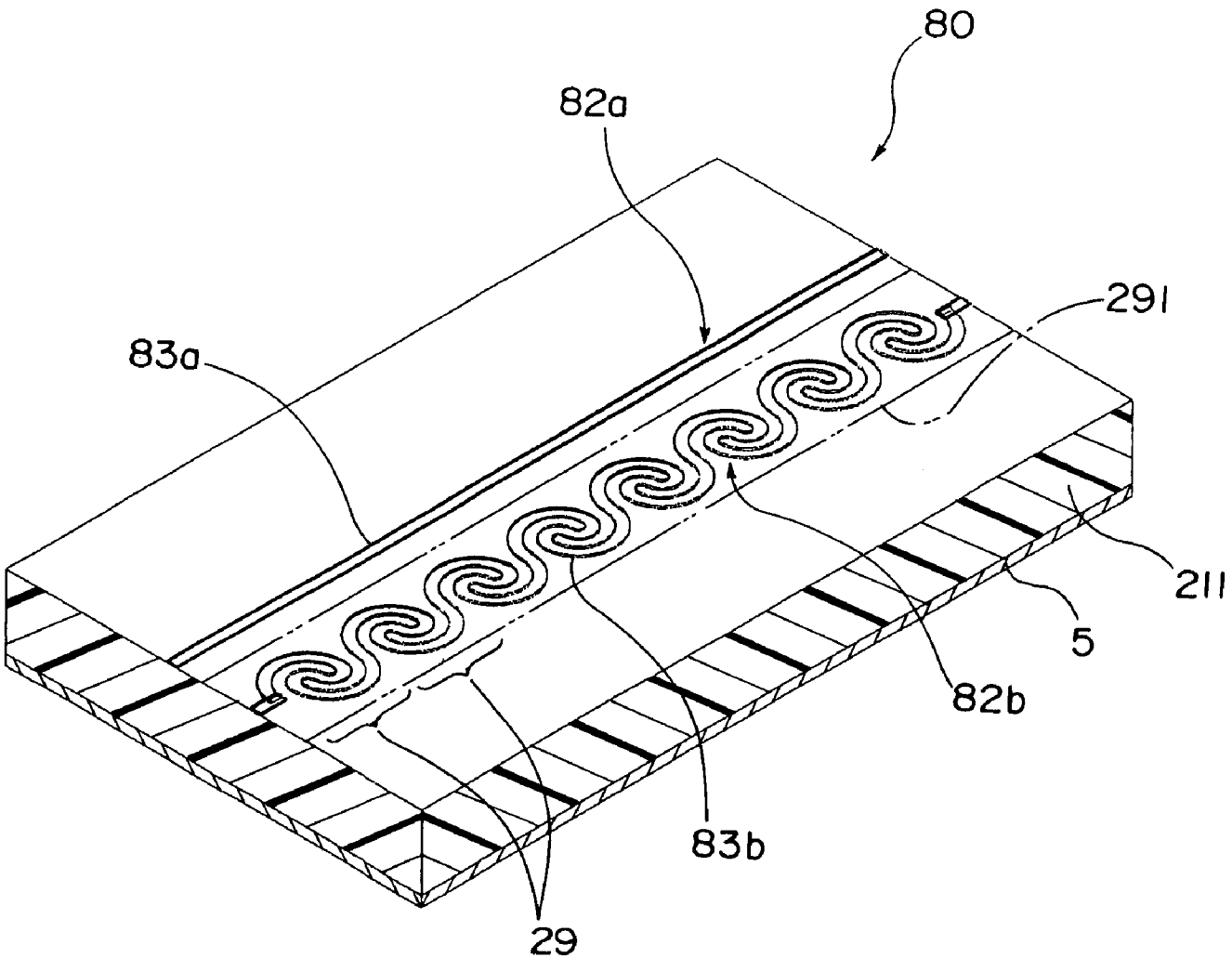
FIG. 15 is a schematic perspective view showing the structure of a transmission line pair according to Working Example 2 of the foregoing embodiment.

Next, a schematic perspective view showing the construction of a transmission line pair 80 according to Working Example 2 is shown in FIG. 15. As shown in FIG. 15, as the transmission line pair 80 of Working Example 2, a transmission line pair was fabricated in such a manner that, in the second transmission line of the transmission line pair of Working Example 1, the surface of the signal conductor whose number of spiral rotations was set to 1 rotation was coated with an epoxy resin having a thickness of 100 μm and a dielectric constant of 3.6. That is, the transmission line pair 80 of the present Working Example 2 was formed, as shown in FIG. 15, by forming a signal conductor 83*a* of the first transmission line 82*a* into a generally linear shape, forming a second signal conductor 83*b* of a second transmission line 82*b* so that a plurality of rotational-direction reversal structures 29 with their number of spiral rotations set to 1 rotation are arrayed cyclically in series, and further placing an additional dielectric 291 so as to cover the second signal conductor 83*b*. That is, the transmission line pair 80 of Working Example 2 is a transmission line pair which is provided with transmission-direction reversal sections and in which an additional dielectric is placed.

Figure 16:
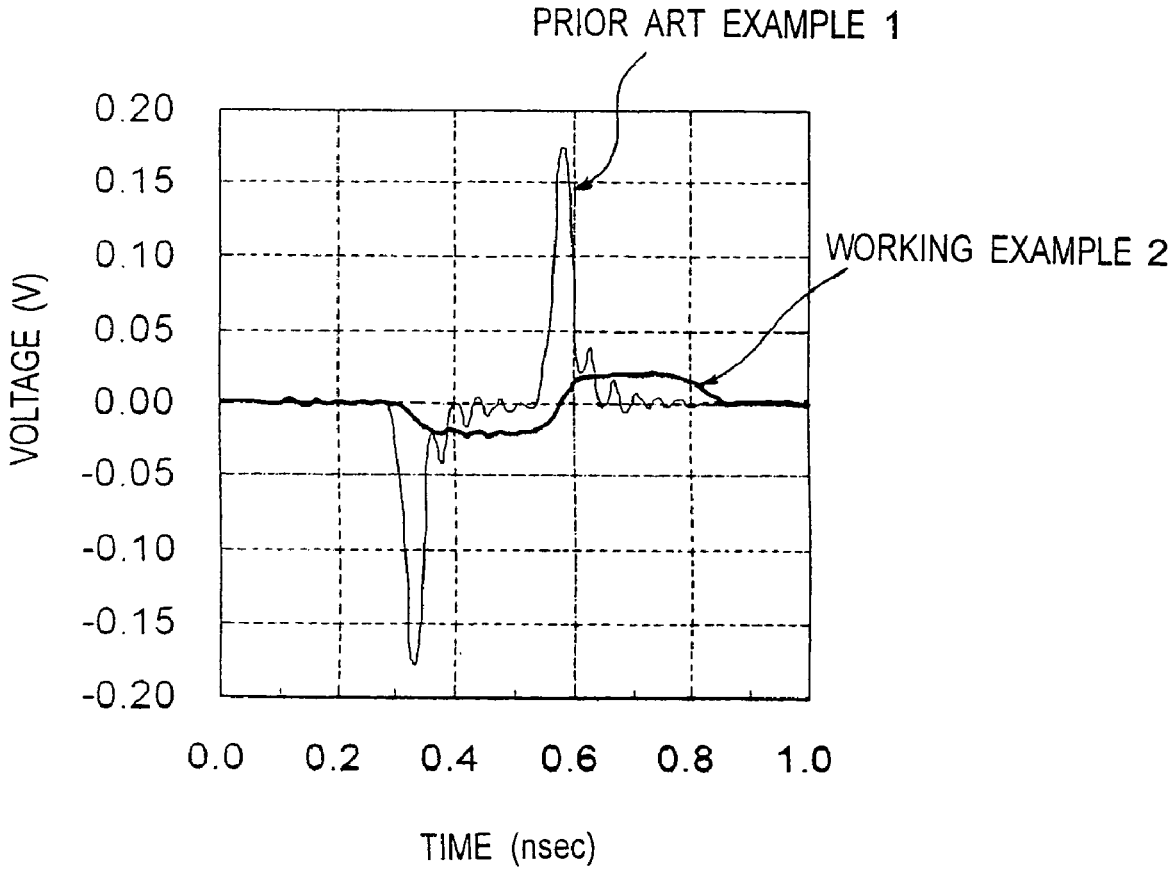
FIG. 16 is a view in the form of a graph showing, in comparison, the crosstalk voltage waveform observed at the far-end crosstalk terminal upon application of a pulse to the transmission line pair of Working Example 2 and the transmission line pair of Prior Art Example 1.
Figure 17A:
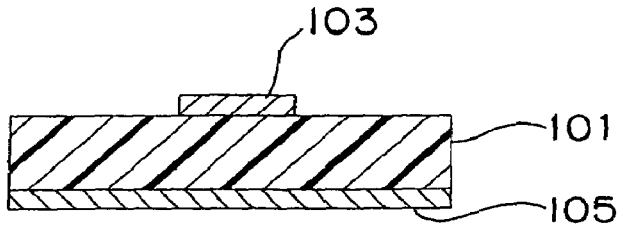
Fig. 17A (PRIOR ART)
FIG. 17A is a schematic sectional view showing the structure of a transmission line pair in the case of a conventional single end transmission.
Figure 17B:
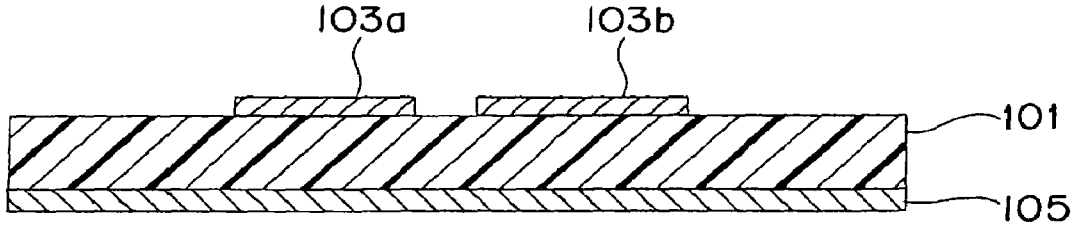
Fig. 17B (PRIOR ART)
FIG. 17B is a schematic sectional view showing the structure of a transmission line in the case of a conventional differential signal transmission.
Figure 18A:
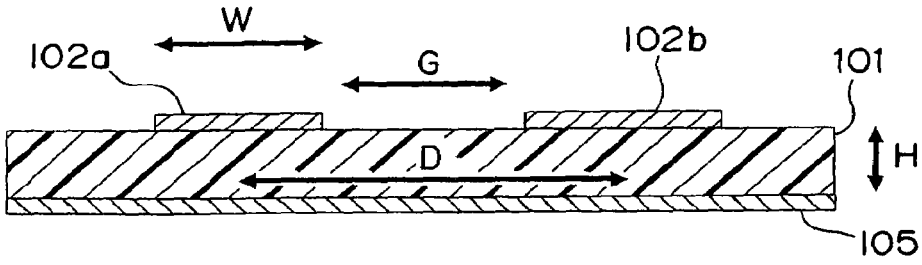
Fig. 18A (PRIOR ART)
FIG. 18A is a schematic sectional view showing the structure of a conventional transmission line pair.
Figure 18B:
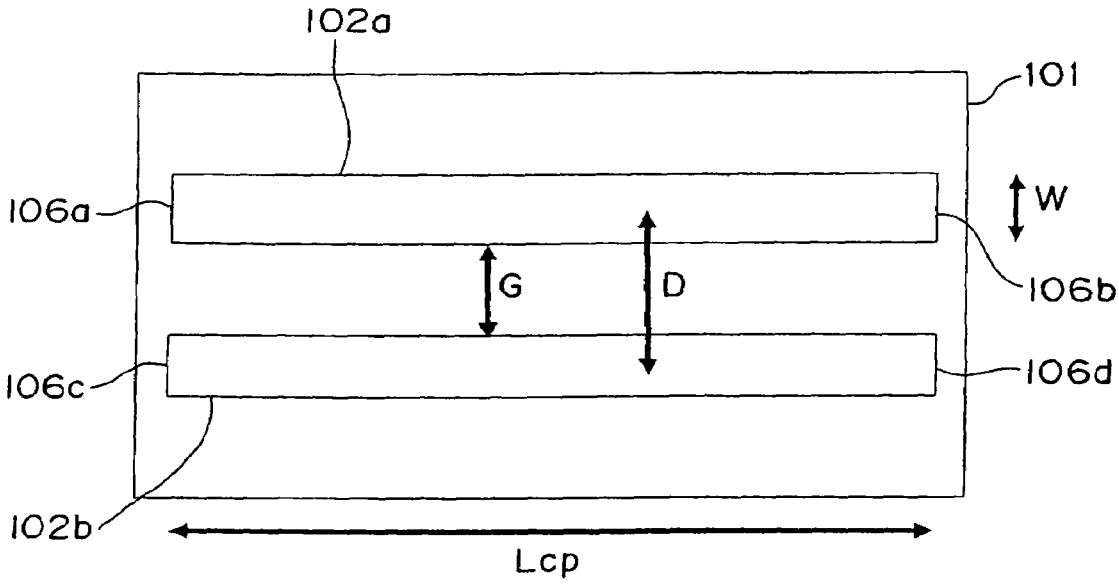
Fig. 18B (PRIOR ART)
FIG. 18B is a schematic plan view of the conventional transmission line pair of FIG. 18A.
Figure 19:
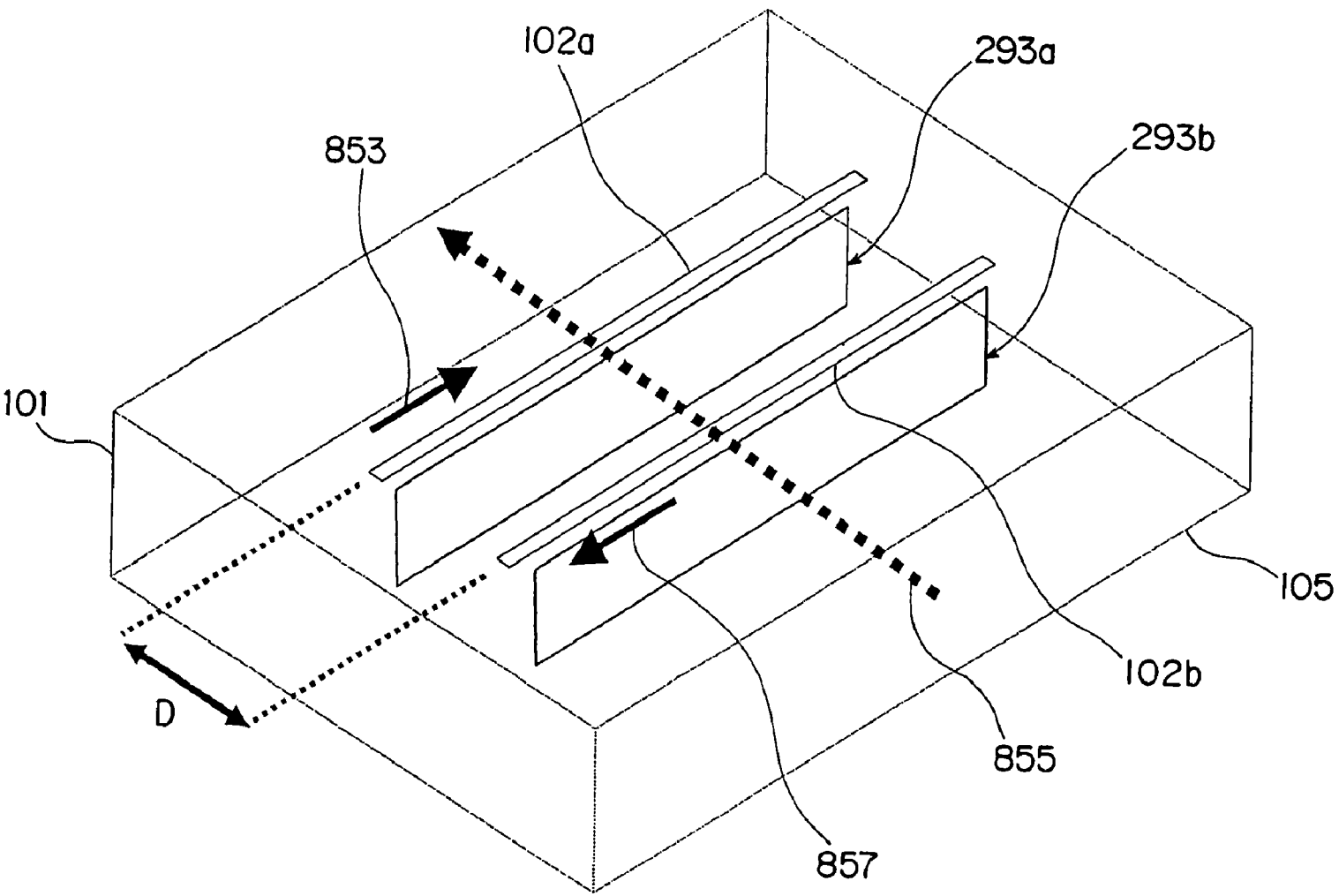
Fig. 19 (PRIOR ART)
FIG. 19 is a schematic explanatory view for explaining the principle of occurrence of a crosstalk signal due to mutual inductance in a conventional transmission line pair.
Figure 20:
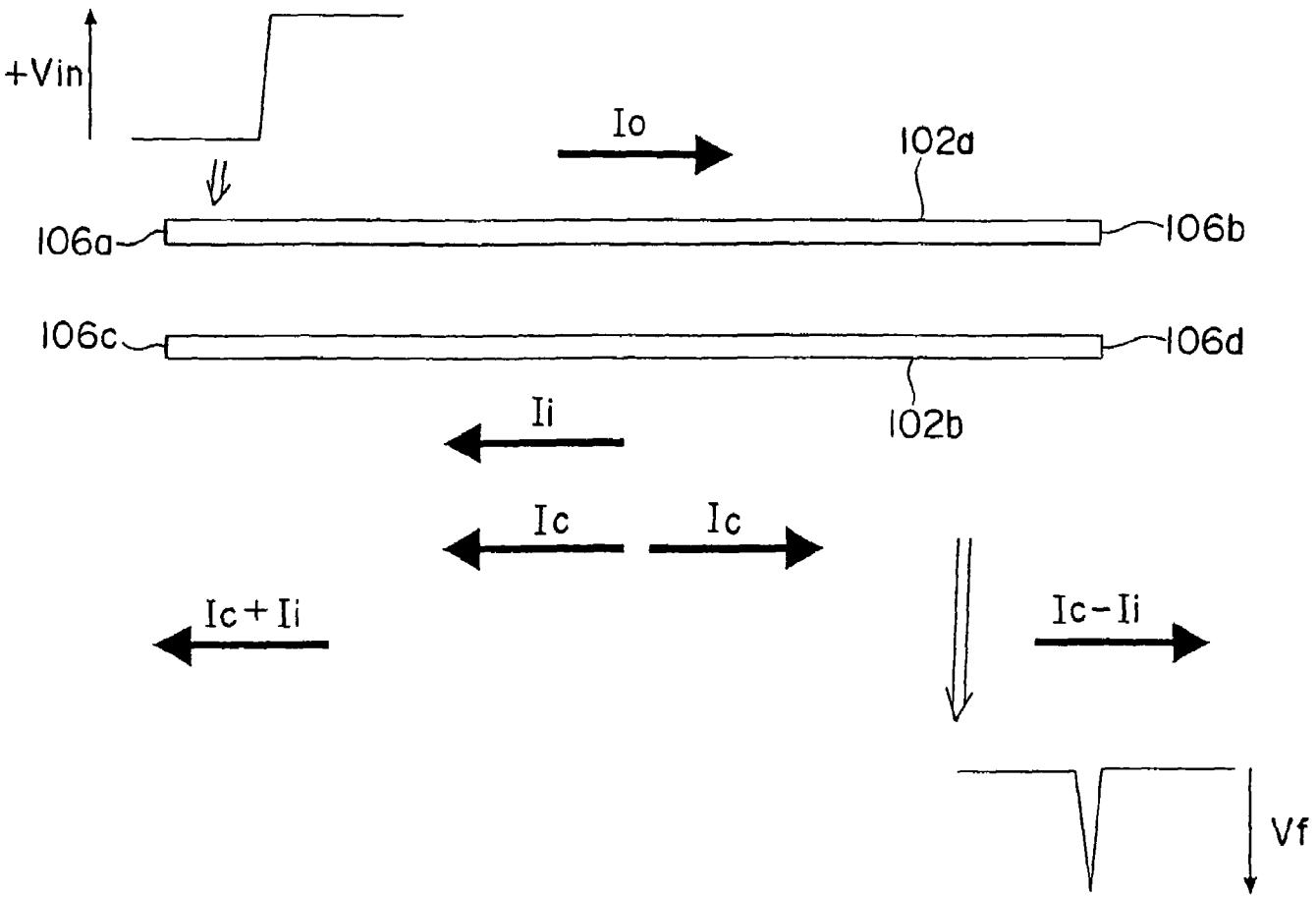
Fig. 20 (PRIOR ART)
FIG. 20 is a schematic explanatory view showing a relationship of current elements related to the crosstalk phenomenon in a conventional transmission line pair.
Figure 21:
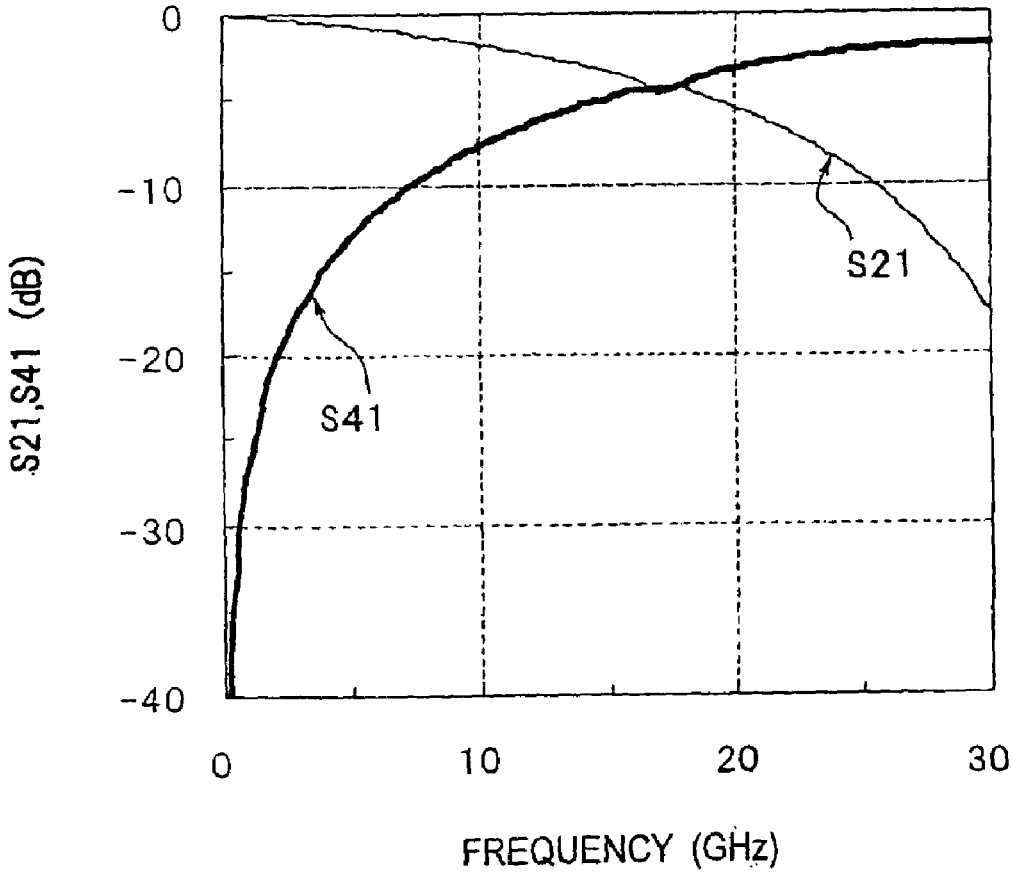
Fig.21 (PRIOR ART)
FIG. 21 is a view in the form of a graph showing the frequency dependence of isolation characteristics and transit intensity characteristics in the transmission line pair of Prior Art Example 1.
Figure 22:
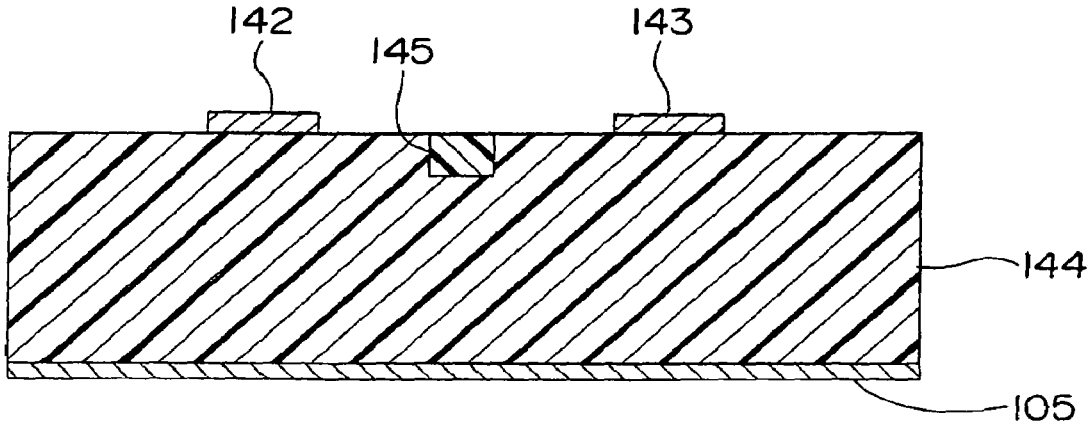
Fig. 22 (PRIOR ART)
FIG. 22 is a schematic sectional view showing a cross-sectional structure of a conventional transmission line pair disclosed in patent document 1.

More specifically, a coupled line length Lcp in the transmission line pair 80 was set to 50 mm as in the transmission line pairs of Prior Art Example 1 and Working Example 1. A pulse with a voltage of 1 V and a rise/fall time of 50 picoseconds was applied also in Working Example 2, as in Prior Art Example 1, and crosstalk waveform at their far-end crosstalk terminals was measured. A comparison of crosstalk waveform between Working Example 2 and Prior Art Example 1 is shown in FIG. 16 by using a graph which represents voltage along the vertical axis and time along the horizontal axis. As shown in FIG. 16, the crosstalk voltage, which was 175 mV in Prior Art Example 1 and 30 mV in Working Example 1, was able to be reduced to 22 mV in Working Example 2.

It is to be noted that, by properly combining the arbitrary embodiments of the aforementioned various embodiments, the effects possessed by them can be produced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The transmission line pair according to the present invention is capable of reducing the crosstalk intensity between lines and transmitting signals with low loss, and moreover making the crosstalk signal waveform formed not into spike noise, which would more likely cause circuit malfunctions, but into a white noise-like one, which is less likely to cause circuit malfunctions. Therefore, as a result, reduction of circuit area by dense wiring, high-speed operations of the circuit (as would conventionally be difficult to do because of signal leak), and power-saving operations of the circuit can be practically fulfilled. Further, the present invention can be widely applied not only to data transmission but also to communication fields such as fillers, antennas, phase shifters, switches and oscillators, and is usable also in power transmission or fields involving use of radio-technique such as ID tags.

Further, since a far-end crosstalk signal has a high-pass characteristic, the issue due to crosstalk rapidly increases as the data transmission speed goes higher or as the frequency band in use goes higher frequency. In an example of low data transmission speed as it stands, the far-end crosstalk seriously matters, in many cases, with a limitation to higher harmonics among broadband signal components from which a data waveform is formed, but fundamental frequency components of transmitted data would seriously be affected by the far-end crosstalk when the data transmission speed is improved in the future. The signal transmission characteristic improving effect offered by the transmission line pair according to the present invention is very effective for the future high-speed data transmission field by virtue of its capabilities of stably obtaining a crosstalk suppression effect without adding any changes in such conditions as processes and wiring rules when the data transmission speed keeps on improving from now on, and making it possible to achieve not only characteristic improvement at harmonic components of data signals but also crosstalk characteristic improvement at fundamental frequency components as well as low loss transmission.

The disclosure of Japanese Patent Application No. 2005-97160 filed on Mar. 30, 2005, including specification, drawing and claims are incorporated herein by reference in its entirety.

What is claimed is:

1. A transmission line pair comprising:

a first transmission line; and a second transmission line which is so placed in adjacency to the first transmission line that a coupled line region is formed, the coupled line region having a coupled line length being 0.5 or more time an effective wavelength in the first transmission line at a frequency of a transmitted signal, wherein in the coupled line region, the first transmission line comprises a first signal conductor which is placed on one surface which is either a top face of a substrate formed from a dielectric or semiconductor or an inner-layer surface parallel to the top face and which has a linear shape along a transmission direction thereof, and the second transmission line comprises a second signal conductor which is placed on the one surface of the substrate and which partly includes a transmission-direction reversal region for transmitting a signal along a direction having an angle of more than 90 degrees with respect to the transmission direction within the plane of the placement, and which has a line length different from that of the first signal conductor, wherein an absolute value of a difference between a product of the coupled line length and a square root of an effective dielectric constant of the first transmission line and a product of the coupled line length and a square root of an effective dielectric constant of the second transmission line is 0.5 or more time a wavelength at the frequency of the signal transmitted in the first transmission line or the second transmission line.

2. The transmission line pair as defined in claim 1, wherein an absolute value of a difference between a product of the coupled line length and a square root of an effective dielectric constant of the first transmission line and a product of the coupled line length and a square root of an effective dielectric constant of the second transmission line is 1 or more time a wavelength at the frequency of the signal transmitted in the first transmission line or the second transmission line.

3. The transmission line pair as defined in claim 1, wherein the transmission-direction reversal region contains a region for transmitting the signal toward a direction rotated 180 degrees with respect to the transmission direction.

4. The transmission line pair as defined in claim 1, further comprising, in the coupled line region, a proximity dielectric placed closer to the second transmission line than to the first transmission line.

5. The transmission line pair as defined in claim 4, wherein at least part of a surface of the second signal conductor is coated with the proximity dielectric.

6. The transmission line pair as defined in claim 1, wherein the second transmission line has an effective dielectric constant higher than an effective dielectric constant of the first transmission line, and a signal transmitted in the first transmission line is higher in a transmission speed than a signal transmitted in the second transmission line.

7. The transmission line pair as defined in claim 6, wherein in the coupled line region, the first transmission line is a differential transmission line including a pair of two transmission lines.

8. The transmission line pair as defined in claim 1, wherein the second transmission line is a bias line for supplying electric power to active elements.

9. The transmission line pair as defined in claim 1, wherein in the coupled line region, the second transmission line has an effective dielectric constant different from an effective dielectric constant of the first transmission line.

10. The transmission line pair as defined in claim 9, wherein an effective-dielectric-constant difference setting region, in which a difference in effective dielectric constant between the first transmission line and the second transmission line is set, is allocated all over the coupled line region.

11. The transmission line pair as defined in claim 9, wherein the coupled line region includes:

an effective-dielectric-constant difference setting region in which a difference in effective dielectric constant between the first transmission line and the second transmission line is set, and an effective-dielectric-constant difference non-setting region in which the difference in effective dielectric constant is not set, wherein a line length of the effective-dielectric-constant difference non-setting region is shorter than 0.5 time the effective wavelength in the first transmission line.

12. The transmission line pair as defined in claim 11, wherein in the coupled line region, a line length of one of the effective-dielectric-constant difference non-setting regions placed in succession is shorter than 0.5 time the coupled line length.

* * * * *